US007092651B2

(12) United States Patent
Yamada

(10) Patent No.: US 7,092,651 B2
(45) Date of Patent: Aug. 15, 2006

(54) IMAGE FORMING APPARATUS METHOD AND STORAGE DEVICE STORING A PROGRAM FOR CONTROLLING IMAGE FORMING OPERATION OF PRIMARILY TRANSFERRING AN IMAGE ONTO AN INTERMEDIATE TRANSFER MEMBER

(75) Inventor: Naoto Yamada, Chiba (JP)

(73) Assignee: Canon Kabushiki Kaisha, (JP)

( * ) Notice: Subject to any disclaimer, the term of this patent is extended or adjusted under 35 U.S.C. 154(b) by 260 days.

(21) Appl. No.: 10/768,681

(22) Filed: Jan. 30, 2004

(65) Prior Publication Data

US 2004/0184827 A1 Sep. 23, 2004

(30) Foreign Application Priority Data

Jan. 31, 2003 (JP) ..... 2003-024816
Jan. 23, 2004 (JP) ..... 2004-015705

(51) Int. Cl.
*G03G 15/043* (2006.01)

(52) U.S. Cl. ..... 399/51; 347/250

(58) Field of Classification Search ..... None
See application file for complete search history.

(56) References Cited

U.S. PATENT DOCUMENTS 5,790,930 A * 8/1998 Fuchiwaki ..... 399/302
6,301,451 B1 * 10/2001 Ando et al. ..... 399/38
6,363,228 B1 * 3/2002 Ream ..... 399/66
6,427,062 B1 * 7/2002 Takeuchi ..... 399/388
6,493,011 B1 * 12/2002 Shioya ..... 347/116

FOREIGN PATENT DOCUMENTS

| | | | |
|---|---|---|---|
| JP | 7-92763 A | | 4/1995 |
| JP | 7-281536 A | | 10/1995 |
| JP | 8-146698 A | | 6/1996 |
| JP | 10-20614 A | | 1/1998 |
| JP | 11015290 A | * | 1/1999 |
| JP | 2002049211 A | * | 2/2002 |
| WO | WO 002099540 A1 | * | 12/2002 |

* cited by examiner

*Primary Examiner*—Robert Beatty
(74) *Attorney, Agent, or Firm*—Rossi, Kimms & MacDowell, LLP

(57) ABSTRACT

An image forming apparatus which is capable of reducing a color misalignment in a color overlapping process, and a color misalignment due to variation of the circumferential length of an intermediate transfer member due to an environmental change over time during a successive copy operation. The image forming apparatus carries out image formation by primarily transferring an image electrophotographically formed on an image carrier onto the rotatably driven intermediate transfer member, and then secondarily transferring the images on the intermediate transfer member onto a recording medium. An image forming operation of primarily transferring the image onto the intermediate transfer member is controlled according to the length of the intermediate transfer member in a circumferentially moving direction thereof and a variation of a predetermined parameter relating to the intermediate transfer member.

6 Claims, 16 Drawing Sheets

IMAGE FORMING APPARATUS METHOD AND STORAGE DEVICE STORING A PROGRAM FOR CONTROLLING IMAGE FORMING OPERATION OF PRIMARILY TRANSFERRING AN IMAGE ONTO AN INTERMEDIATE TRANSFER MEMBER

BACKGROUND OF THE INVENTION

1. Field of the Invention

The present invention relates to an image forming apparatus, a control method therefor and a program for implementing the control method, and more particularly relates to an image forming apparatus that electrophotographically forms an image on a recording medium, by primarily transferring a toner image formed on a photosensitive member onto an intermediate transfer member, and then secondarily transferring the toner image on the intermediate transfer member onto the recording medium, such as a copying machine, a multifunction apparatus, and a printer, as well as a control method for the image forming apparatus and a program for implementing the control method.

2. Description of the Related Art

There has been known an image forming apparatus that electrophotographically forms an image, such as a copying machine, a multifunction apparatus, and a printer, in which a toner image formed on a photosensitive member is once primarily transferred onto an intermediate transfer member, the toner image is then secondarily transferred onto a recording medium such as a recording sheet or an OHP sheet, and the toner image on the recording medium is fixed, thereby forming an image. As the intermediate transfer member used in the above described transfer, a drum-shaped intermediate transfer member and a belt-shaped intermediate transfer member are actually used. The intermediate transfer belt method using the belt-shaped intermediate transfer member is currently attracting attention due to it being advantageous in saving installation space in an image forming apparatus since the miniaturization of image forming apparatuses has been desired these days.

When a full-color image is formed by an image forming apparatus that carries out the transfer using the intermediate transfer belt, since it is difficult to form overlapped toner images on the photosensitive member, toner images of three colors of yellow, cyan, and magenta or those of four colors including black in addition to these three colors are sequentially primarily transferred from the photosensitive member onto the intermediate transfer belt, and the toner images of the full color overlapped on the intermediate transfer belt are secondarily transferred onto a recording medium at once, thereby forming a full-color image.

To achieve a good image quality of the full-color image obtained by the above described process, it is necessary to accurately align the multi-color toner images to be overlapped on the intermediate transfer belt. Specifically, if the toner images in three colors or four colors are slightly displaced from the position in which they are to be overlapped, the resulting image has a color completely different from that of the original image formed on a medium such as an original, which necessitates carrying out the accurate alignment.

Conventionally, to accurately align multi-color toner images on the intermediate transfer belt, a reference mark serving as a reference of the image formation timing is provided at a predetermined position on the intermediate transfer belt, the reference mark is detected by an optical sensor or the like provided at a predetermined position on a conveying path for the intermediate transfer belt, and the image forming process is started in predetermined timing after the detection of the reference mark so that the multi-color toner images are primarily transferred and overlapped at a given position on the intermediate transfer belt. In addition, other improved techniques have been proposed for more accurate alignment of multi-color toner images (for example, Japanese Laid-Open Patent Publications (Kokai) No. H7-92763 and No. H7-281536).

However, if the image formation is carried out successively using these conventional methods, a defect may occur in the image due to degradation of the intermediate transfer belt. Specifically, according to these methods, since the toner images are always overlapped at a certain area on the intermediate transfer belt, there occurs such a phenomenon that an aging change of the state of a conducting agent inside the intermediate transfer belt causes a decrease in the resistance value of that area on the intermediate transfer belt. Such decrease in the resistance value of the specific area on the intermediate transfer belt causes a difference in primary and second transferability between the area having the decreased resistance and the other areas, and an image defect such as a void becomes remarkable when a large halftone image is formed across the area having the decreased resistance value and another area.

To solve this problem, there has been proposed a technique that a plurality of reference marks are provided on the intermediate transfer belt, any one of these reference marks is detected by a photo sensor, the timing of exposure on the photosensitive members is controlled to predetermined timing so as to accurately align multi-color toner images formed, and at the same time, primarily transfer the toner images at different positions on the intermediate transfer belt (for example, Japanese Laid-Open Patent Publication (Kokai) No. H8-146698).

When the timing of the image forming process is controlled based on the plurality of reference marks provided on the intermediate transfer belt as above, an identification mark should be added to each reference mark for identification, and the control should be carried out while the identification mark is identified using a sensor. Specifically, for example, if a yellow toner image is transferred onto the intermediate transfer belt with reference to a reference mark "a" provided at a predetermined position on the intermediate transfer belt, the reference mark "a" must be also used as a reference when the next toner image such as a cyan toner image is transferred onto the intermediate transfer belt to overlap the next toner image on the yellow toner image. If another reference mark "b" is used as a reference, a color misalignment occurs.

However, there is such a case where the sensor cannot identify the identification mark added to the reference mark on the intermediate transfer belt which rotates in synchronism with the speed of image formation on the recording medium. Particularly, recently, high speed image formation has been required, so that it is difficult for the sensor to accurately read the identification marks on the intermediate transfer belt which rotates at a high speed for such high speed image formation. Although this problem can be solved by using a high performance sensor which can accurately read the identification marks even if the intermediate transfer belt is rotating at a high speed, such a sensor is disadvantageous in terms of cost. Apart from this problem, there is a problem that the identification marks disappear when the surface of the intermediate transfer belt is cleaned using a cleaning blade, and consequently the sensor cannot read the identification marks on the intermediate transfer belt. In these cases, the proper timing control cannot be carried out, and as a result, a color misalignment may occur.

Further, if the timing of the image forming process is controlled based on the plurality of reference marks provided on the intermediate transfer belt as described above, after preparation for (toner) image formation for a first color has been completed, a first reference mark is detected and then image formation is started. As a result, at least a wait time period from the completion of preparation for the image formation to the detection of the first reference mark is added to a FCOT (first copy out time) for the full-color image formation.

Therefore, a method for actively reducing the above described wait time has recently been studied. According to this method, the circumferential length in the circumferential direction (rotational direction) of the intermediate transfer member is detected and stored in a RAM or the like in advance. After the preparation for image formation is completed, image formation start signals are generated in arbitrary timing according to a program. Specifically, an image formation start signal for a first color is generated in arbitrary timing, and then a next image formation start signal for a next color is generated upon the lapse of a one-turn time period required for the intermediate transfer member to make one turn, which is calculated from the stored circumferential length and the rotational speed of the intermediate transfer member. As a result, the wait time until the detection of the first reference mark can be eliminated, providing an advantage of reduction of the FCOT for the full-color image formation compared with the method of starting the image formation based on the reference marks (for example, Japanese Laid-Open Patent Publication (Kokai) No. H10-20614).

Further, in the case where the image formation start signal is generated using the one-turn time period calculated in advance as described above, when a plurality of full-color images are successively output, there has been the problem that various mechanical shocks or mechanical load fluctuations occur due to contacting and separation of the cleaning blade with and from the intermediate transfer member, that is, a mechanical shock caused by the separation of the cleaning blade from the intermediate transfer member when a toner image is formed on the intermediate transfer member for a first color of a first recording sheet; a mechanical shock caused by contacting of a secondary transfer roller with the recording sheet when a color toner image is secondarily transferred on a recording sheet after a tone image of a fourth color is overlapped on the intermediate transfer member; a mechanical shock caused by contacting of the cleaning blade with the intermediate transfer member for cleaning the same; and other mechanical load fluctuations caused by contacting and separation of the cleaning blade with and from the intermediate transfer member. These mechanical load fluctuations cause variations in the rotational speed of the intermediate transfer member such that the one-turn time period varies between the respective colors. This results in a color misalignment between the first color and second and subsequent colors in the color overlapping process.

SUMMARY OF THE INVENTION

It is an object of the present invention to provide an image forming apparatus, a control method therefor, and a program for implementing the control method, which are capable of reducing a color misalignment in a color overlapping process, and a color misalignment due to variation of the circumferential length of an intermediate transfer member due to an environmental change over time during a successive copy operation.

To attain the above objects, in a first aspect of the present invention, there is provided an image forming apparatus that carries out image formation by primarily transferring an image electrophotographically formed on an image carrier onto a rotatably driven intermediate transfer member, and then secondarily transferring the images on the intermediate transfer member onto a recording medium, comprising a controller that controls an image forming operation of primarily transferring the image onto the intermediate transfer member, according to a length of the intermediate transfer member in a circumferentially moving direction thereof and a variation of a predetermined parameter relating to the intermediate transfer member.

Preferably, the image forming apparatus comprises a circumferential length detecting device that detects a circumferential length as the length of the intermediate transfer member in the circumferentially moving direction thereof, a signal generating device that generates an image formation start signal for a plurality of respective colors, a target value setting device that sets a target value of image formation timing to be input to the signal generating device based on the circumferential length detected by the circumferential length detecting device, and an offset value adding device that adds an offset value determined according to an expected load variation to the target value set by the target value setting device.

More preferably, the circumferential length detecting device comprises a reference member detecting device that detects a reference member attached to the intermediate transfer member, and a measuring device that measures a time period elapsed from generation of a first detection signal acquired from the reference member detecting device to generation of a second detection signal acquired from the reference member detecting device as a result of circumferential movement of the intermediate transfer member.

More preferably, the signal generating device comprises four signal generating devices provided respectively for yellow, magenta, cyan, and black, and the target value setting device sets target values of image formation timing for respective ones of the four signal generating devices.

More preferably, the signal generating device comprises at least two signal generating devices provided respectively at least for a face A corresponding to recording mediums at odd number-th positions attached to the intermediate transfer member, and a face B corresponding to recording mediums attached to the intermediate transfer member at even number-th positions, and the target value setting device sets target values of image formation timing for respective ones of the two signal generating devices for the face A and the face B.

More preferably, the offset value added by the offset value adding device is for correcting values of mechanical shocks different between respective colors, generated during the image forming operation of primarily transferring the image onto the intermediate transfer member.

More preferably, the offset value added by the offset value adding device is for correcting a change in the circumferential length of the intermediate transfer member due to an environmental change over time during a successive output operation of successively forming images.

Still more preferably, the image forming apparatus comprises an environmental change detecting device that detects a change in temperature and humidity as the environmental change.

Preferably, the intermediate transfer member comprises one selected from the group consisting of a belt type and a drum type.

Preferably, the image forming apparatus comprises one selected from the group consisting of a printer, a copying machine, and a multifunction apparatus.

To attain the above objects, in a second aspect of the present invention, there is provided an image formation control method for an image forming apparatus that carries out image formation by primarily transferring an image electrophotographically formed on an image carrier onto a rotatably driven intermediate transfer member, and then secondarily transferring the images on the intermediate transfer member onto a recording medium, comprising a control step of controlling an image forming operation of primarily transferring the image onto the intermediate transfer member, according to a length of the intermediate transfer member in a circumferentially moving direction thereof and a variation of a predetermined parameter relating to the intermediate transfer member.

Preferably, the image formation control method comprises a circumferential length detecting step of detecting a circumferential length as the length of the intermediate transfer member in the circumferentially moving direction thereof, a signal generating step of generating an image formation start signal for a plurality of respective colors, a target value setting step of setting a target value of image formation timing to be input to the signal generating step based on the circumferential length detected in the circumferential lengths detecting step, and an offset value addition step of adding an offset value determined according to an expected load variation to the target value set in the target value setting step.

More preferably, the circumferential length detecting step comprises a reference member detecting step of detecting a reference member attached to the intermediate transfer member, and a measurement step of measuring a time period from generation of a first detection signal acquired in the reference member detecting step to generation of a second detection signal acquired in the reference member detecting step as a result of circumferential movement of the intermediate transfer member.

More preferably, the signal generating step comprises four signal generating steps provided respectively for yellow, magenta, cyan, and black, and the target value setting step comprises setting target values of image formation timing for respective ones of the four signal generating steps.

More preferably, the signal generating step comprises at least two signal generating steps provided respectively at least for a face A corresponding to recording mediums at odd number-th positions attached to the intermediate transfer member, and a face B corresponding to recording mediums attached to the intermediate transfer member at even number-th positions, and the target value setting step comprises setting target values of image formation timing for respective ones of the two signal generating steps for the face A and the face B.

More preferably, the offset value added in the offset value addition step is for correcting values of mechanical shocks different between respective colors, generated during the image forming operation of primarily transferring the image onto the intermediate transfer member.

More preferably, the offset value added in the offset addition step is for correcting a change in the circumferential length of the intermediate transfer member due to an environmental change over time during a successive output operation of successively forming images.

Still more preferably, the image formation control method comprises an environmental change detecting step of detecting a change in temperature and humidity as the environmental change.

Preferably, the intermediate transfer member comprises one selected from the group consisting of a belt type and a drum type.

Preferably, the image formation control method is applied to an image forming apparatus selected from the group consisting of a printer, a copying machine, and a multifunction apparatus.

To attain the above objects, in a third aspect of the present invention, there is provided a program for causing a computer to execute an image formation control method for an image forming apparatus that carries out image formation by primarily transferring an image electrophotographically formed on an image carrier onto a rotatably driven intermediate transfer member, and then secondarily transferring the images on the intermediate transfer member onto a recording medium; comprising a control module for controlling an image forming operation of primarily transferring the image onto the intermediate transfer member, according to a length of the intermediate transfer member in a circumferentially moving direction thereof and a variation of a predetermined parameter relating to the intermediate transfer member.

According to the present invention, in the image forming apparatus that carries out image formation by primarily transferring an image electrophotographically formed on an image carrier onto the rotatably driven intermediate transfer member, and then secondarily transferring the images on the intermediate transfer member onto a recording medium, the image forming operation of primarily transferring the image onto the intermediate transfer member is controlled according to the length of the intermediate transfer member in the circumferentially moving direction thereof and a variation of the predetermined parameter relating to the intermediate transfer member. As a result, it is possible to reduce a color misalignment in the color overlapping process and a color misalignment due to a change in the circumferential length of the intermediate transfer member due to an environmental change over time during a successive copy operation.

The above and other objects, features, and advantages of the invention will become more apparent from the following detailed description taken in conjunction with the accompanying drawings.

BRIEF DESCRIPTION OF THE DRAWINGS

FIGS. 11A and 11B are flowcharts showing the procedure of setting the top signal generating counters, in which:

FIG. 11A shows the case of image top signal generating counters for yellow; and FIG. 11B shows the case of image top signal generating counters for magenta;

FIGS. 12A and 12B are flowcharts showing the procedure of setting the top signal generating counters, in which:

FIG. 12A shows the case of image top signal generating counters for cyan; and FIG. 12B shows the case of image top signal generating counters for black;

FIGS. 15A and 15B are flowcharts the procedure of setting the top signal generating counters during a successive copy operation, in which:

FIG. 15A shows the case of image top signal generating counters for yellow; and FIG. 15B shows the case of image top signal generating counters for magenta; and FIGS. 16A and 16B are flowcharts the procedure of setting top signal generating counters during the successive copy operation, in which:

FIG. 16A shows the case of image top signal generating counters for cyan; and FIG. 16B shows the case of image top signal generating counters for black.

DETAILED DESCRIPTION OF THE PREFERRED EMBODIMENTS

Figure 1:
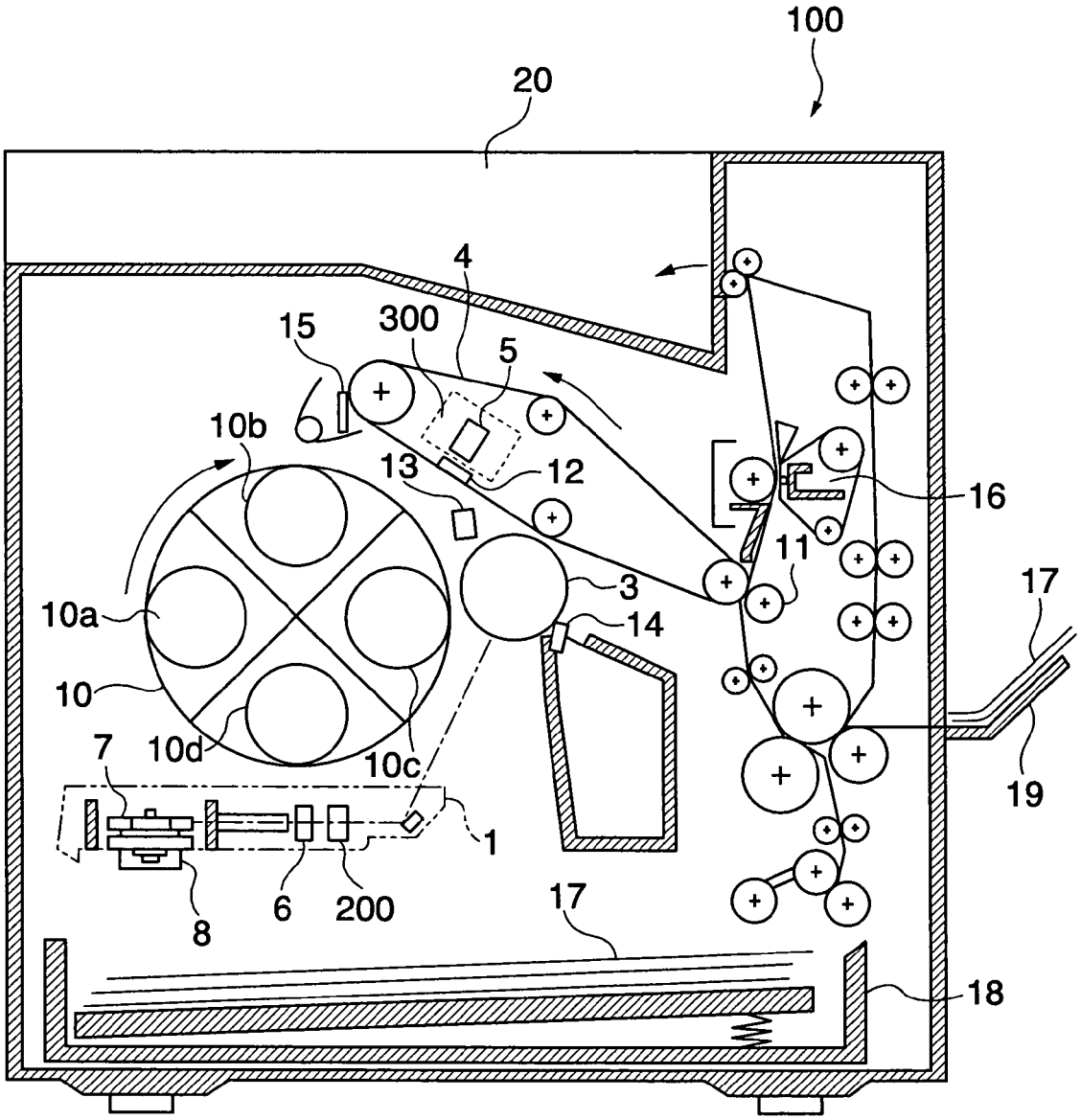
FIG. 1 is a schematic cross sectional view showing the construction of an image forming apparatus according to a first embodiment of the present invention.

The present invention will now be described later in detail with reference to the accompanying drawings showing preferred embodiments thereof. In the drawings, elements and parts which are identical throughout the views are designated by identical reference numeral, and duplicate description thereof is omitted.

FIG. 1 is a schematic cross sectional view showing the construction of an image forming apparatus according to a first embodiment of the present invention. The image forming apparatus 100 according to the present invention is implemented by a copying machine, for example. The image forming apparatus 100 is comprised of a scanner unit 1 including a laser unit (hereinafter simply referred to as "the laser") 6, a polygon mirror 7, a scanner motor 8, and a beam detection signal (BD signal) generating circuit 200, a photosensitive drum 3, an intermediate transfer belt 4, a circumferential length detecting sensor 5, a developing rotary 10 including developer units 10*a* to 10*d* of respective colors, a secondary transfer roller 11, an environment sensor 13, cleaning blades 14 and 15, a fixing device 16, recording mediums 17 such as recording sheets, a sheet feed cassette 18, a manual feed cassette 19, and a sheet discharge opening 20. In the present and following second embodiments, a description will be given mainly of control relating to color alignment in a sub scanning direction of respective colors: yellow (Y), magenta (M), cyan (C), and black (Bk) in the image forming apparatus 100, and illustration and description of an original reading mechanism which reads an image from an original to be copied are omitted.

A description will now be given of the constructions of the respective sections of the image forming apparatus 100. In the scanner unit 1, the laser 6 emits laser light modulated based on an image signal output from an image forming section 27 shown in FIG. 4 described later. The polygon mirror 7 is a rotary polygon mirror which scans the surface of the photosensitive drum 3 by deflecting the laser light emitted from the laser 6, and forms an electrostatic latent image on the photosensitive drum 3. The scanner motor 8 rotatably drives the polygon mirror 7. The beam detection signal (BD signal) generating circuit 200 detects the laser light deflected by the polygon mirror 7 in the main scanning direction. The developing rotary 10 develops the electrostatic latent image formed on the photosensitive drum 3 using developer units 10*a*, 10*b*, 10*c*, and 10*d* of the respective colors: yellow (Y), magenta (M), cyan (C), and black (Bk). The photosensitive drum 3 primarily transfers the developer on the photosensitive drum 3 developed by the developing rotary 10 onto the intermediate transfer belt 4. The secondary transfer roller 11 is disposed in contact with the intermediate transfer belt 4, and secondarily transfers the developers on the intermediate transfer belt 4 onto the recording medium such as a recording sheet fed from the sheet feed cassette 18 or the manual feed tray 19. The circumferential length detecting sensor 5 detects a circumferential length, which is the length of the intermediate transfer belt 4 in the circumferential direction (rotational direction), and is disposed in the measuring circuit 300 provided inside a unit of the intermediate transfer belt 4. An optical reflection type sensor is used as the circumferential length detecting sensor 5 in the present embodiment.

The intermediate transfer belt 4 is stretched across the outer peripheries of a plurality of rollers as shown in FIG. 1, and is driven for rotation by the respective rollers. A reference mark 12 is provided on the rear surface of the intermediate transfer belt 4. In the present embodiment, the reference mark 12 is comprised of a seal made of a material having a high reflectivity. Specifically, a light source such as an LED, not shown, irradiates light on the reference mark 12 provided on the rear surface of the intermediate transfer belt 4, and the circumferential length detecting sensor 5 detects the reflected light from the reference mark 12. It should be noted that in FIG. 1, the photosensitive drum 3 is rotatively driven in the clockwise direction, and the intermediate transfer belt 4 is rotatively driven in the counterclockwise direction which is reverse to the rotational direction of the photosensitive drum 3, by a drive mechanism, not shown, both at the same constant speed. The environment sensor 13 detects the temperature and the humidity, and the amount of the moisture around the intermediate transfer belt 4 is calculated based on the detection result of the environment sensor 13. The details of control using the environment sensor 13 will be described with reference to a second embodiment of the invention, described later.

The cleaning blade 14 is always disposed in contact with the photosensitive drum 3, and cleans the photosensitive drum 3 by scraping off residual toner on the surface. The cleaning blade 15 is configured and disposed such that it can be separated from and brought in contact with the intermediate transfer belt 4, and cleans the intermediate transfer belt 4 by scraping off residual toner on the surface when it is in contact with the belt 4. The fixing device 16 carries out a fixing operation by heating and pressing toner images which have been transferred onto the recording sheet 17. The sheet feed cassette 18 stores a plurality of recording sheets 17, and a recording sheet 17 fed out from the sheet feed cassette 18 is fed to a secondary transfer position on the intermediate transfer belt 4. The manual feed tray 19 is used for manually feeding a recording sheet 17, and a recording sheet 17 inserted into the manual feed tray 19 is fed to the secondary transfer position on the intermediate transfer belt 4. The sheet discharge opening 20 discharges the recording sheet 17 on which the image formation (copy) has completed.

A description will now be given of the operations of the respective sections of the image forming apparatus. 100. First, the image formation is carried out for yellow (Y) data. Specifically, upon receiving a start instruction for an image forming job by an user via an operating section, not shown, of the image forming apparatus 100, initialization is carried out for image forming preparation, and then top signal (TOP*) generation counters, not shown, which are provided inside the top signal generating section 22 shown in FIG. 4, described later, and have set target values for the respective colors, are started by a trigger of an electrical START signal generated according to a program. A top signal for yellow (Y), the first color, is generated when the value of a top signal generating counter for yellow (Y) reaches the target value, the write timing of the laser 6 inside the scanner unit 1 is set according to the top signal, thereby causing the laser 6 to emit laser light, whereby a latent image according to the data of yellow (Y) is formed on the photosensitive drum 3.

Then, the photosensitive drum 3 is rotated by the drive mechanism, not shown, and the latent image on the photosensitive drum 3 is visualized by the developer of yellow (Y) at a position where the photosensitive drum 3 comes in contact with the developer unit of yellow (Y) 10*a* in the developing rotary 10. The photosensitive drum 3 is further rotated by the drive mechanism, and the developer of yellow (Y) on the photosensitive drum 3 is primarily transferred onto the intermediate transfer belt 4 at a position where the photosensitive drum 3 comes in contact with the intermediate transfer belt 4. Then, the developing rotary 10 rotates by approximately 90 degrees in preparation for the development of the next color, magenta (M).

Then, the image formation for magenta (M) is carried out. Specifically, top signal generating counters, not shown, which are provided inside the top signal generating section 22 shown in FIG. 4, and have set target values for the respective colors, are started as described above by a trigger of the top signal generated when the yellow (Y) data was generated. A top signal for magenta (M), the second color, is generated when the value of the top signal generating counter for magenta (M) reaches the target value, the write timing of the laser 6 inside the scanner unit 1 is set according to the top signal, thereby causing the laser 6 to emit laser light. A latent image according to the data of magenta (M) is formed on the photosensitive drum 3 by the emission of the laser light from the laser 6 when the intermediate transfer belt 4 is at the same rotation position as the formation of the latent image of yellow (Y).

Then, the photosensitive drum 3 is rotated by the drive mechanism, and the latent image on the photosensitive drum 3 is visualized by the developer of magenta (M) when the intermediate transfer belt 4 is at the same rotation position as the visualization of the latent image of yellow (Y). The photosensitive drum 3 is further rotated by the drive mechanism, and the developer of magenta (M) on the photosensitive drum 3 is primarily transferred onto the intermediate transfer belt 4 when the intermediate transfer belt 4 is at the same rotation position as the primary transfer of the developer of yellow (Y).

Thereafter, similar control is carried out for cyan (C) and black (Bk) in the image forming process described above. When the developers of the four colors: yellow (Y), magenta (M), cyan (C), and black (Bk) have been overlapped on the intermediate transfer belt 4, a recording sheet 17 is fed from the sheet feed cassette 18 or the manual feed tray 19, and the secondary transfer roller 11 is brought in contact with the intermediate transfer belt 4. Consequently, the secondary transfer roller 11 secondarily transfers the developers on the intermediate transfer belt 4 onto the recording sheet 17. Then, the secondary transfer roller 11, which has been in contact with the intermediate transfer belt 4, is separated after the entire developers have been transferred onto the recording sheet 17. Then, the developers on the recording sheet 17 are fixed by the fixing device 16, and the recording sheet 17 on which the image has been formed is discharged into the discharge opening 20.

A description will now be given of the cleaning operation of the intermediate transfer belt 4 using the cleaning blade 15, described later. As preprocessing for the above described image formation of the four colors, the cleaning blade 15 is brought in contact with the intermediate transfer belt 4 to clean the intermediate transfer belt 4 before the development of yellow (Y), which is the first color, is carried out. The cleaning blade 15, which has been in the contact state, is separated from the intermediate transfer belt 4 before the leading end of the developer of yellow (Y), which is the first color primarily transferred onto the intermediate transfer belt 4, reaches the cleaning blade 15, and the preprocessing of cleaning is completed. Further, when the developers of the four colors have been overlapped and secondarily transferred onto the recording sheet 17 as described above, the cleaning blade 15 is again brought in contact with the intermediate transfer belt 4 to scrape off the remaining developers on the intermediate transfer belt 4. When the developers have been completely scraped off, the blade 15 is separated from the intermediate transfer belt 4, and the preprocessing of cleaning is completed.

It should be noted that the above described target values set for the respective colors: yellow (Y), magenta (M), cyan (C), and black (Bk) are determined based on the detection result of the circumferential length of the intermediate transfer belt 4 by the circumferential length detecting sensor 5 provided inside the unit of the intermediate transfer belt 4.

A description will now be given of how to detect the circumferential length.

Figure 2:
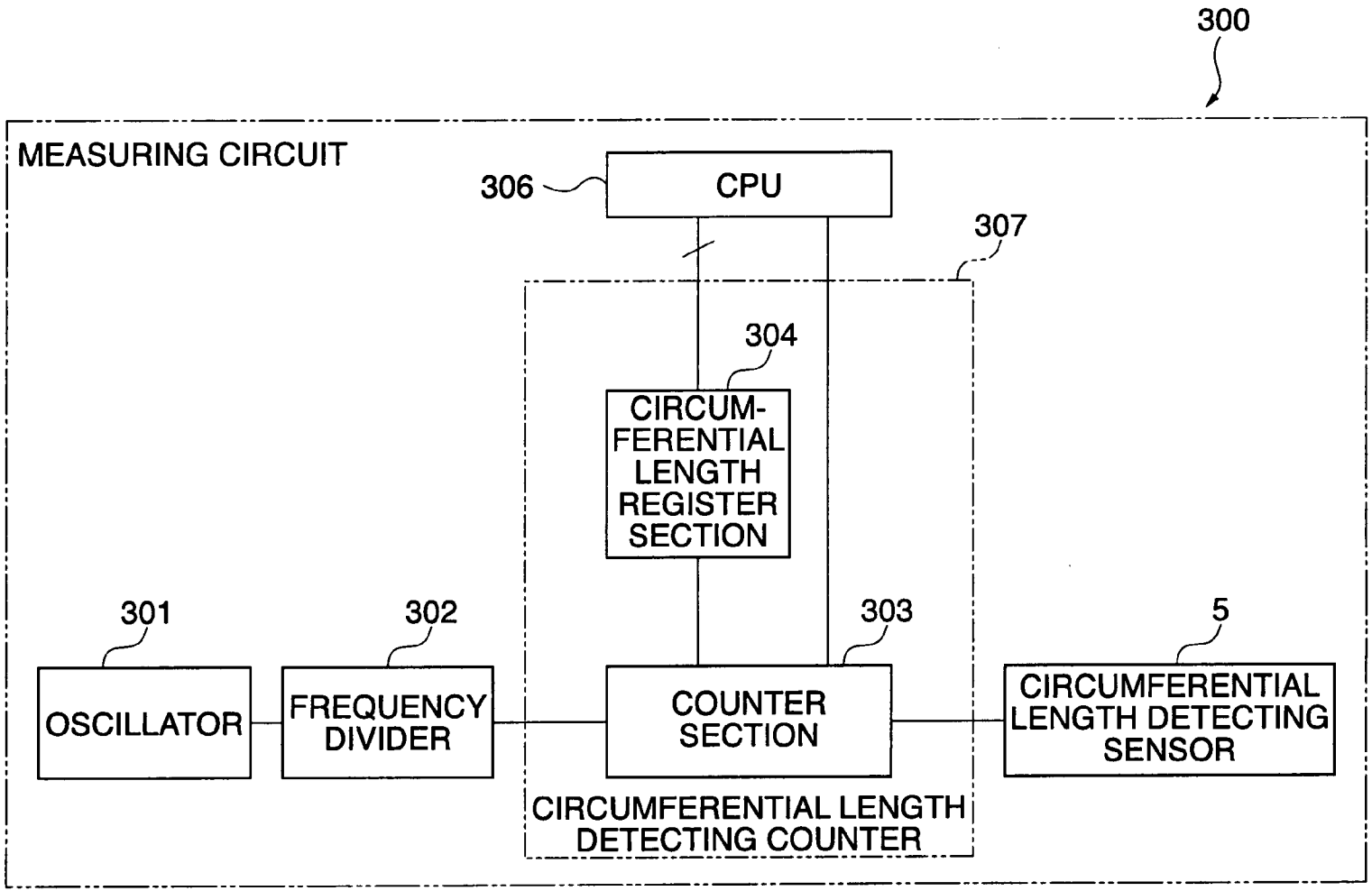
FIG. 2 is a block diagram showing the construction of a measuring circuit 300 that measures the circumferential length of an intermediate transfer belt 4 in the image forming apparatus 100 in FIG. 1.

FIG. 2 is a block diagram showing the construction of the measuring circuit 300 of the image forming apparatus 100 in FIG. 1.

As shown in FIG. 2, the measuring circuit 300 is comprised of an oscillator 301, a frequency divider 302, a CPU 306, a circumferential length detecting counter 307 including a counter section 303 and a circumferential length register section 304, and the circumferential length detecting sensor 5 appearing in FIG. 1, and measures the circumferential length of the intermediate transfer belt 4.

The oscillator 301 generates primary clock signal (base clock). The frequency divider 302 generates a reference clock for the circumferential length detecting counter 307 based on the primary clock input from the oscillator 301. The CPU 306 is connected to the circumferential length detecting counter 307, and controls the respective sections in FIG. 2. The counter section 303 carries out a count operation, described later. The circumferential length register section 304 stores a count value counted by the counter section 303.

A description will now be given of the operation of the above construction. The primary clock generated by the oscillator 301 is input to the frequency divider 302, which in turn generates the reference clock for the circumferential length detecting counter 307. The circumferential length detecting counter 307 is connected to the CPU 306. The CPU 306 can always read the count value of the counter section 303 loaded in the circumferential length register section 304 of the circumferential length detecting counter 307, and generates an enable signal for the counter section 303 of the circumferential length detecting counter 307.

The counter section 303 of the circumferential length detecting counter 307 starts counting the reference clock in response to a trigger composed of the enable signal from the CPU 306 and the detection signal from the circumferential length detecting sensor 5. When the next detection signal is input from the circumferential length detecting sensor 5, the counter section 303 loads the count value at this point into the circumferential length register section 304, and then the counter section 303 is cleared, and repeats the count. Namely, the counter section 303 measures a time period from a first detection signal acquired from the circumferential length detecting sensor 5 to a second detection signal acquired from the same as a result of the rotation (circumferential movement) of the intermediate transfer-belt 4.

A description will now be given of a setting sequence of the actual target values set for the respective colors: yellow (Y), magenta (M), cyan (C), and black (Bk) with the above described construction of the image forming apparatus 100. First, in timing when a mechanical shock applied to the intermediate transfer belt 4, which occurs during image formation, for example, during the initialization upon turning-on of the power supply of the image forming apparatus 100 (such as shocks caused by contacting/separation of the cleaning blade 15 and the secondary transfer roller 11 with/from the intermediate transfer belt 4), a circumferential length detection sequence is carried out for detection of the circumferential length of the intermediate transfer belt 4 using the circumferential length detecting sensor 5 and the circumferential length detecting counter 307.

Figure 3:
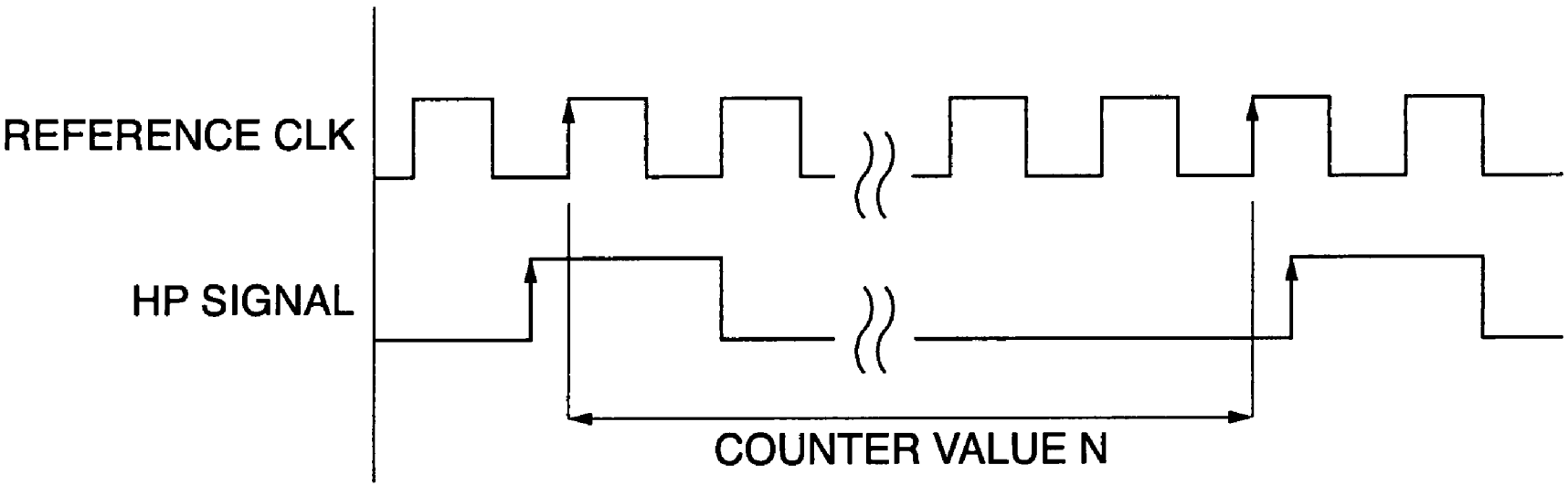
FIG. 3 is a view useful in explaining the operation of a circumferential length detecting counter 307 in FIG. 2.

FIG. 3 is a view useful in explaining the operation of the circumferential length detecting counter 307 in FIG. 2. First, the circumferential length detecting sensor 5 detects the reference mark 12 on the rear surface of the intermediate transfer belt 4 as the intermediate transfer belts 4 rotates, and the counter section 303 of the circumferential length detecting counter 307 receives the detection signal (HP signal) from the circumferential length detecting sensor 5. The counter section 303 starts counting the reference clock supplied to the circumferential length detecting counter 307 upon rise of the detection signal. When the intermediate transfer belt 4 further rotates, the circumferential length detecting sensor 5 again detects the reference mark 12. At this point, the counter section 303 of the circumferential length detecting counter 307 stores the number of the reference clock inputs supplied until immediately before the input of the detection signal (HP signal) generated by the second detection by the sensor 5, and loads the count value into the circumferential length register section 304 inside the circumferential length detecting counter 307.

In this way, the circumferential length of the intermediate transfer belt 4 can be measured with the resolution of the reference clock supplied to the circumferential length detecting counter 307 based on the count value acquired as described above, and the one-turn time period of the intermediate transfer belt 4 can be managed based on the circumferential length of the intermediate transfer belt 4 and the rotational speed (speed of rotating operation) of the intermediate transfer belt 4 during the image formation. However, the actual one-turn time period of the intermediate transfer belt 4 for each color has a certain offset to the one-turn time period calculated as described above due to mechanical shocks applied to the intermediate transfer belt 4 (such as shocks caused by contacting/separation of the cleaning blade 15 and the secondary transfer roller 11 with/from the intermediate transfer belt 4) during the image formation, as described later. Thus, the target values of the respective colors input to the top signal generating counters (signal generating sections) for the respective colors during the image formation are set by adding the respective offset values thereto.

The method of calculating the offset values includes, for example, a method in which the cleaning blade 15 and the secondary transfer roller 11 are intentionally brought into contact and separated for each one turn of the intermediate transfer belt 4, and the difference Δ in one-turn time period from the case where the cleaning blade 15 and the secondary transfer roller 11 are not brought into contact and separated is calculated and stored as the offset value before the delivery of the image forming apparatus from the factory, and a method in which a predetermined value is initially set as the offset value, and during the image formation, the CPU 306 causes the circumferential length detecting counter 307 to start operation in timing when the cleaning blade 15 and the secondary transfer roller 11 are not brought into contact and separated, the circumferential length of the intermediate transfer belt 4 is measured, then further, the CPU 306 causes the circumferential length detecting counter 307 to start operation in timing when the cleaning blade 15 and the secondary transfer roller 11 are brought into contact and separated, the circumferential length of the intermediate transfer belt 4 is measured, and the resulting difference Δ in one-turn time period is calculated as the offset value, to correct the initially set value using the calculated offset value and store the correct value.

Further, the target values of the top signal generating counters (signal generating sections) can be set independently for the respective four colors: yellow (Y), magenta (M), cyan (C), and black (Bk). Further, the target values can also be set independently for a surface A corresponding to odd number-th recording sheets attached to the intermediate transfer belt 4, and for a surface B corresponding to even number-th recording sheets attached to the intermediate transfer belt 4.

On the other hand, even when the top positions (image leading end positions as the leading end of the image formation timing) for the respective colors: yellow (Y), magenta (M), cyan (C), and black (Bk) are accurately synchronized with each other, if the top signal (TOP*) indicating a start position of writing in the sub scanning direction for each of the respective colors acquired by the rotation of the intermediate transfer belt 4, and the beam detection signal (BD) indicating a start position of writing in the main scanning direction for the color acquired by the rotation of the scanner motor 8 are not synchronized with each other, the start position of writing for the color in the sub scanning direction can be displaced by an amount corresponding to the difference between the phase of the top signal and that of the BD signal, namely by an amount corresponding to one line in the sub scanning direction at the maximum. This problem might be solved if the one-turn time period of the intermediate transfer belt 4 were exactly an integer multiple of the period of the BD signal. However, in actuality, it is difficult to exactly set the one-turn time period of the intermediate transfer belt 4 to an integer multiple of the period of the BD signal, since such setting restricts the design of the image forming apparatus 100.

To solve this problem, the present embodiment employs a known prior technique using a simple method in which a target signal as a reference corresponding to the position of the polygon mirror 7 provided on the scanner motor 8 is generated every time the intermediate transfer belt 4 makes one rotation, and the rotation of the scanner motor 8 is controlled by phase control based on the target signal. With this prior technique, the image forming apparatus 100 can be completely free from color misalignment between the respective colors: yellow (Y), magenta (M), cyan (C), and black (Bk), as a multi-color (full color) image forming apparatus.

Figure 4:
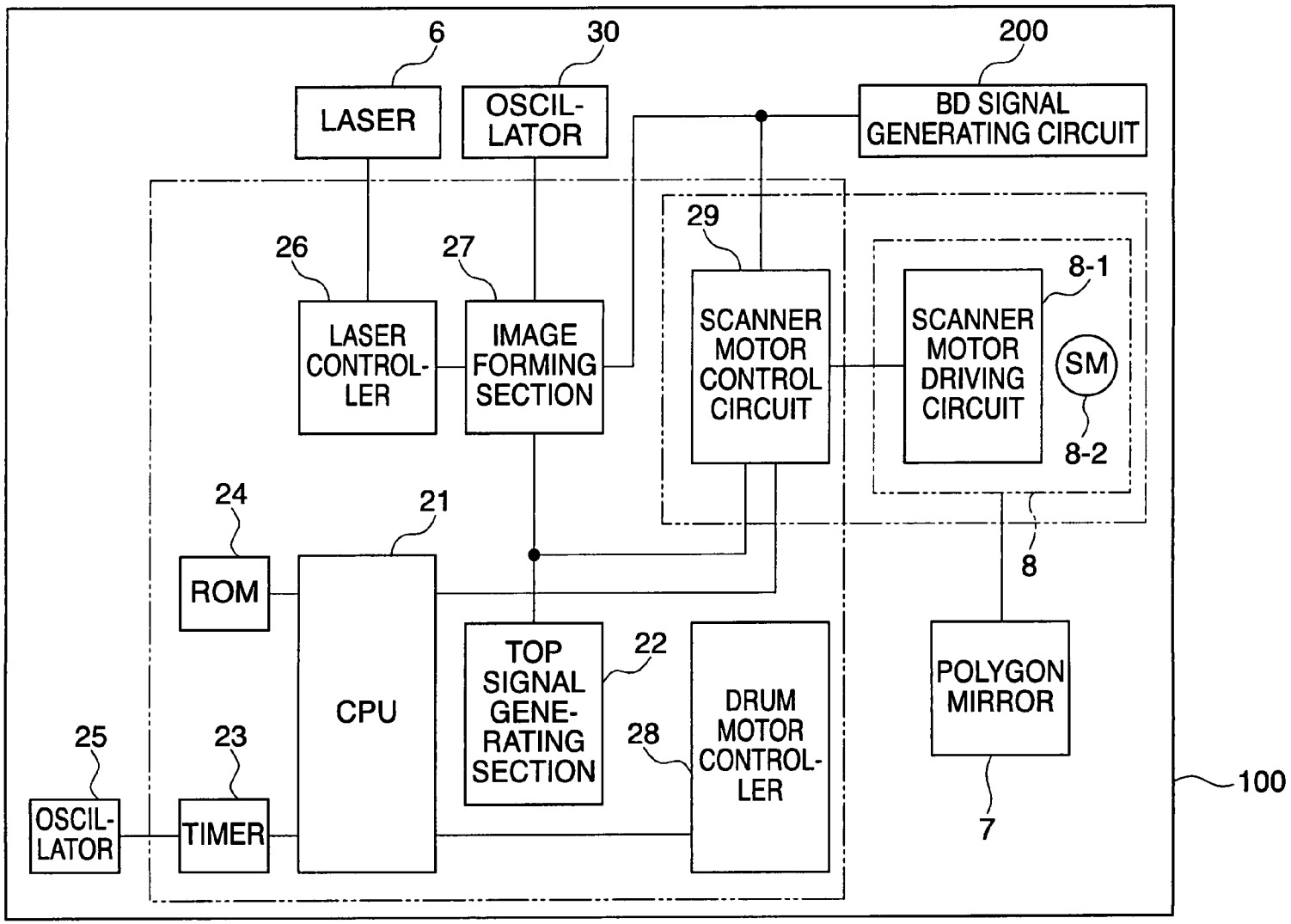
FIG. 4 is a block diagram showing the construction of a scanner motor control system of the image forming apparatus in FIG. 1.

FIG. 4 is a block diagram showing the construction of a scanner motor control system of the image forming apparatus 100. The image forming apparatus 100 is comprised of the laser 6, the polygon mirror 7, the scanner motor 8 including a scanner motor driving circuit 8-1 and a scanner motor main body (SM) 8-2, a CPU 21, the top signal generating section 22, a timer 23, a ROM 24, an oscillator 25, a laser controller 26, the image forming section (image formation control circuit) 27, a drum motor controller 28, a scanner motor control circuit 29, an oscillator 30, and the beam detection signal (BD signal) generating circuit 200. Parts and elements in FIG. 4 corresponding to those in FIG. 1 are designated by identical reference numerals.

The CPU 21 controls the entire image forming apparatus 100 based on a program stored in the ROM 24, and carries out processes shown in respective flowcharts, described later, by controlling the CPU 306, the circumferential length detecting counter 307, the environment sensor 13, and others. The CPU 21 has a memory (work area for the CPU 21), not shown, therein or at another location. The ROM 24 stores various control programs executed by the CPU 21. The drum motor controller 28 rotates and stops the intermediate transfer belt 4 and the photosensitive drum 3. The top signal generating section 22 starts the timer 23 based on a predetermined step number for one turn of the intermediate transfer belt 4 and the one-turn time period determined in advance as described above, thereby electrically generating the top signals (TOP*) for the respective colors during the actual image formation.

The oscillator 25 generates a clock signal serving as a reference time of the operation of the CPU 21. The timer 23 divides the output frequency of the oscillator 25, to provided a divided frequency clock as a reference of time period measurement or the like. At least part of the construction of FIG. 4 may be implemented by a one-chip CPU in general, which makes it possible to accommodate the CPU 21, the top signal generating section 22, the timer 23, the ROM 24, and the drum motor controller 28 in the one chip, and thus further reduce the size and cost of the image forming apparatus 100.

The scanner motor 8 has attached thereto the polygon mirror 7 appearing in FIG. 1, includes the scanner motor driving circuit 8-1 and the scanner motor main body (SM) 8-2, and rotates and stops under the control of the scanner motor control circuit 29 according to instructions from the CPU 21. The beam detection signal (BD signal) generating circuit 200 generates the beam detection signal (BD signal) serving as a start reference signal (synchronizing signal in the main scanning direction) in the main scanning direction by detecting laser light deflected by the polygon mirror 7 as the polygon mirror 7 rotates. If the polygon mirror 7 has six surfaces, the beam detection signal (BD signal) is generated six times during one rotation of the scanner motor 8.

The oscillator 30 generates a reference clock for the operation of the image forming section (image formation control circuit) 27. The image forming section 27 is comprised of a sub scanning control circuit and a main scanning control circuit, generates timing for video data generation through communication with a controller, not shown, synchronizes the sub scanning and the main scanning with each other based on the top signal (TOP*) and the beam detection signal (BD signal), and generates a laser light emission signal corresponding to a video signal. The laser controller 26 synchronizes the sub scanning of the respective colors according to a print instruction from the CPU 21 and the top signal (TOP*) from the top signal generating section 22, to thereby control the driving of the laser 6. The laser 6 receives a signal from the laser controller 26, and forms a latent image on the photosensitive drum 3 using the laser light. The scanner motor control circuit 29 has a control circuit operating to eliminate the phase difference from the actual BD signal by generating a target BD signal serving as a reference immediately after the generation of the electrical top signal (TOP*).

Figure 5:
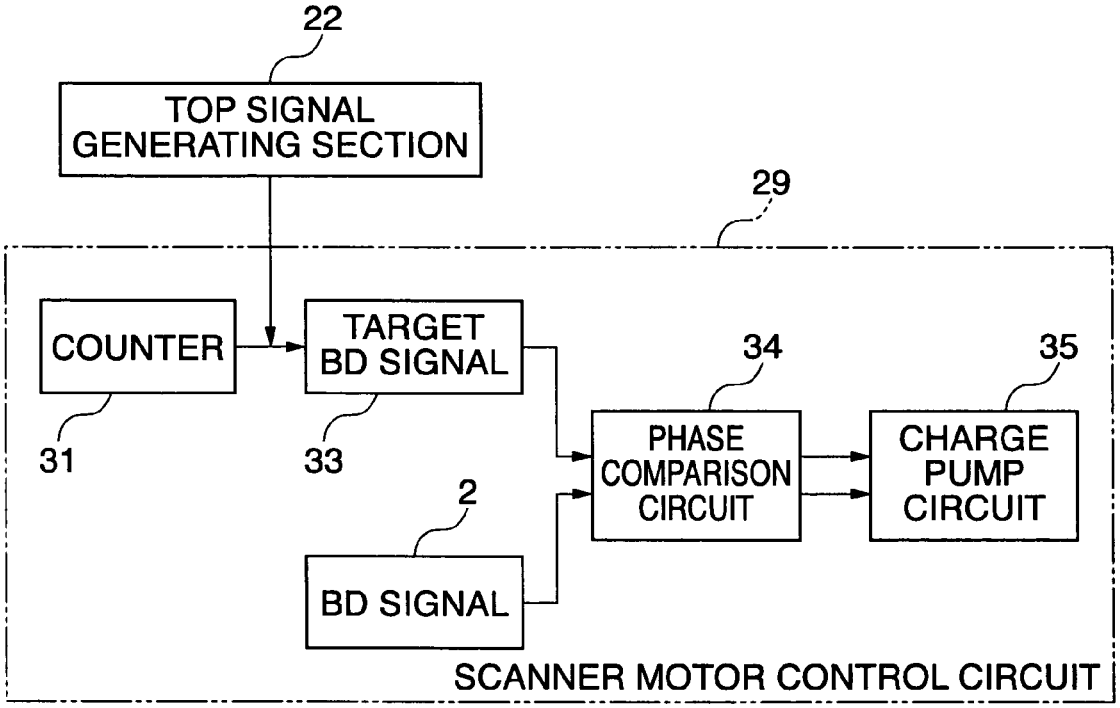
FIG. 5 is a block diagram showing the detailed construction of a scanner motor control circuit 29 appearing in FIG. 4.

FIG. 5 is a block diagram showing the detailed construction of the scanner motor control circuit 29 in FIG. 4. The scanner motor control circuit 29 is comprised of a counter 31, a phase comparison circuit 34, and a charge pump circuit 35. Reference numeral 22 designates the top signal generating section; 2, the BD signal inside the scanner motor control circuit 29; and 33, the target BD signal inside the scanner motor control circuit 29. Parts and elements in FIG. 5 corresponding to those in FIG. 4 are designated by identical reference numerals.

The counter 31 of the scanner motor control circuit 29 generates the target BD signal 33 as the reference. The scanner motor control circuit 29 is configured so as to reset the counter 31 to newly generate the target BD signal immediately after the detection of the output (TOP*) from the top signal generating section 22. The phase comparison circuit 34 compares the phase of the target BD signal 33 generated by the counter 31 and the phase of the actual BD signal 2 detected by the beam detection signal (BD signal) generating circuit 200 with each other, and outputs a LAG signal and a LEAD signal, described later. The charge pump circuit 35 receives the output signals from the phase comparison circuit 34, and converts the phase difference between the two signals into a control voltage. Specifically, the time period corresponding to the phase difference is directly used as a control variable for use in proportional operation, and the charge pump circuit 35 generates control voltage which is constant in absolute value but has a positive value or negative value depending upon whether the phase difference indicates "lead" or "lag".

Figure 6:
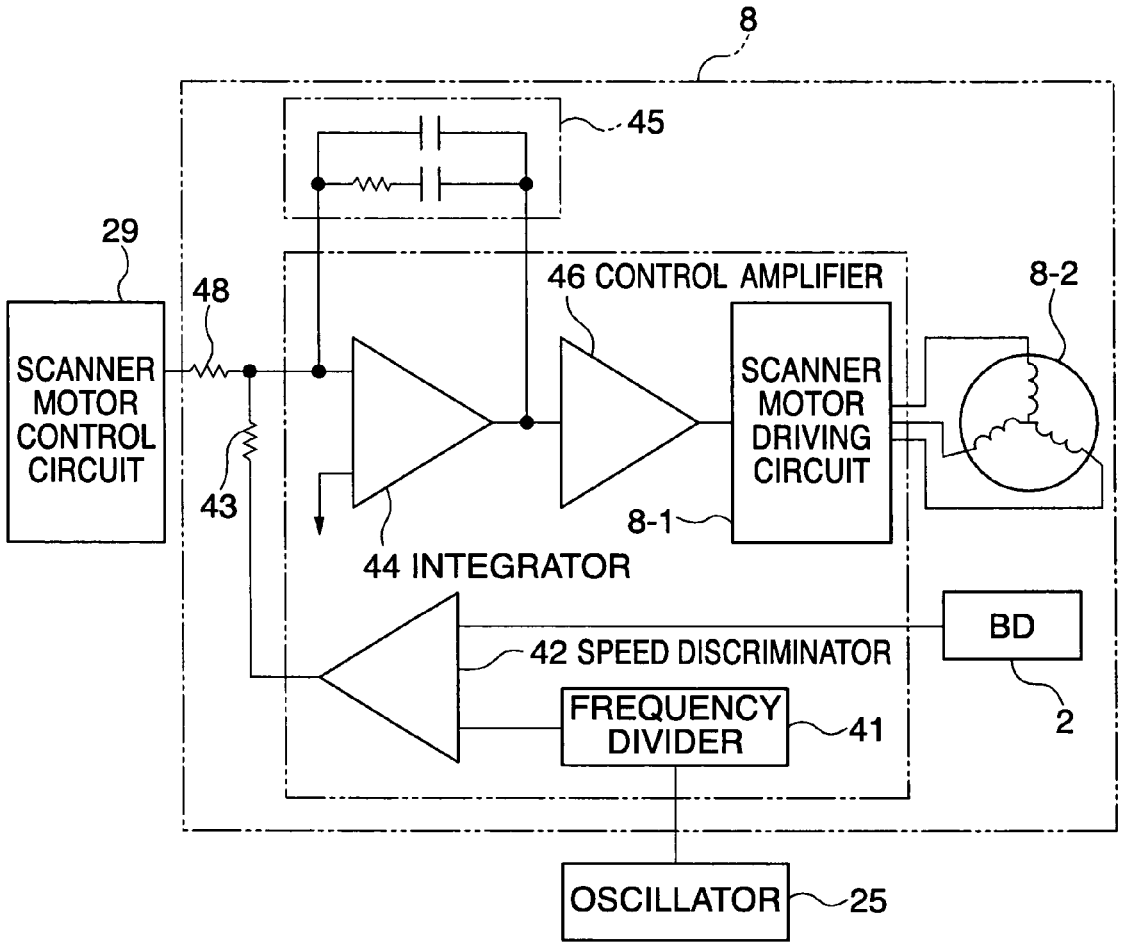
FIG. 6 is a block diagram showing the detailed construction of a scanner motor control/driving circuit provided in a scanner motor 8 appearing in FIG. 4.

FIG. 6 is a block diagram showing the detailed construction of the scanner motor control/driving circuit of the scanner motor 8 in FIG. 4. The scanner motor 8 is comprised of the scanner motor driving circuit 8-1, the scanner motor main body (SM) 8-2, the frequency divider 41, a speed discriminator 42, a resistor 43, an integrator 44, an integrating filter 45, a control amplifier 46, and a resistor 48. In FIG. 6, reference numeral 25 designates the oscillator appearing in FIG. 4. Parts and elements in FIG. 6 corresponding to those in FIG. 4 are designated by identical reference numerals.

The scanner motor control/driving circuit constructed as above is a control circuit that drivingly controls the scanner motor main body (SM) 8-2 using the control signal from the scanner motor control circuit 29 appearing in FIG. 4. The frequency divider 41 divides the frequency of the reference clock generated by the oscillator 25 with a predetermined division ratio, thereby generating a frequency serving as a reference speed of the scanner motor main body 8-1. The speed discriminator 42 compares the BD signal 2 used for the detection of the rotational speed of the polygon mirror 7 (see FIG. 1) attached to the scanner motor 8, and the output signal from the frequency divider 41 which generates the frequency serving as the reference speed of the polygon mirror 7, and discriminates the speed of the polygon mirror 7 based on the comparison result.

The integrator 44 receives the control signal output from the scanner motor control circuit 29 via the resistor 48, and a control signal output from the speed discriminator 42 via the resistor 43, and operates as an integrator having predetermined gain and frequency characteristics determined by the integrating filter 45 comprised of a resistor and capacitors, and the resistor 43. The control amplifier 46 receives a signal output from the integrator 44 and amplifies the signal to a predetermined gain so as to drive the scanner motor main body 8-2. The scanner motor driving circuit 8-1 is composed of transistors and other devices and parts, and drives the scanner motor main body 8-2.

A description will now be given of the operation of controlling the scanner motor 8. When the rotation control of the scanner motor 8 by the scanner motor control/driving circuit constructed as above is carried out, the speed discriminator 42 carries out the rotation control through a feedback control loop in which it is determined whether the scanner motor 8 is operating at a predetermined rotational speed or not by monitoring the BD signal 2, and then an output signal is generated such that if the rotational speed of the scanner motor 8 has not reached the predetermined rotational speed, the rotational speed is increased, or if the rotational speed has exceeded the predetermined rotational speed, the rotational speed is decreased. It should be noted that since this feedback control loop does not include control based on the phase difference between the BD signal and the output signal from the frequency divider 41 whose frequency serves as the reference rotational speed, the scanner motor 8 is controlled to a rotational speed slightly deviated from the predetermined rotational speed due to an offset voltage of the integrator 44.

To accurately control the rotational speed of the scanner motor 8 to the predetermined reference rotational speed, an output indicative of the phase difference between the target BD signal 33 and the actual BD signal 2 obtained from the scanner motor control circuit 29 is input to the integrator 44 via the resistor 48 in parallel with the input via the resistor 43, thereby carrying out PLL (Phase Locked Loop) speed control. The gain of the PLL control loop can be considerably smaller than the gain of the speed discriminator 42, and thus the resistance value of the resistor 48 may be set to ten times or more of the resistance value of the resistor 43. This is because if the gain of the PLL control is high, the follow-up to the reference phase is improved, but the ability to lock-in of the PLL degrades. As a result of the additional provision of the PLL control of the phase difference between the target BD signal 33 and the actual BD signal 2, it is possible to control the rotational speed of the scanner motor 8 to the rotational speed at which the actual BD signal 2 is generated with the period of the target BD signal 33.

A detailed description will now be given of the operation of the PLL control operation of the image forming apparatus 100 with reference to a timing chart in FIG. 7.

Figure 7:
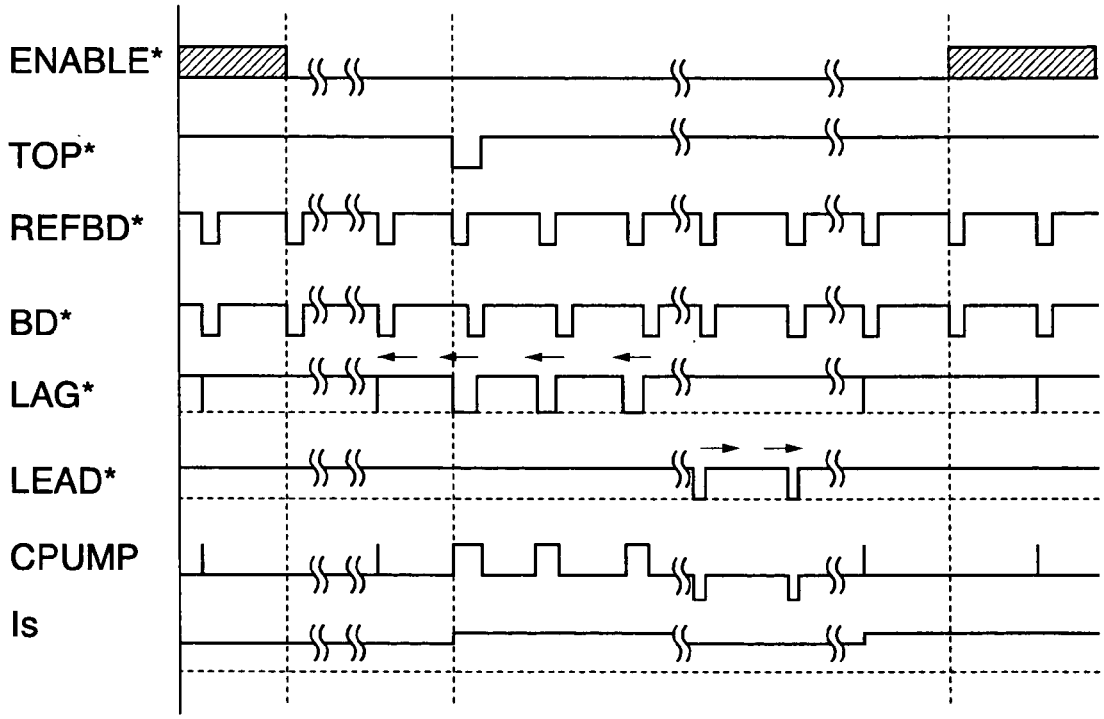
FIG. 7 is a timing chart showing a PLL control operation of the scanner motor 8 by the scanner motor control circuit 29 in FIG. 4.

FIG. 7 is a timing chart showing the PLL control operation of the scanner motor 8 by the scanner motor control circuit 29 in FIG. 4.

In FIG. 7, symbol "ENABLE *" designates a signal indicating a print area/a non-print area (an area where latent image is not formed in the sub scanning direction on the photosensitive drum 3). "High" areas filled in black in the chart indicate print areas, and the other areas indicate non-print areas. Symbol "TOP *N" designates a TOP signal, which is generated by the top signal generating section 22 as a synchronizing signal for the start of the print in the sub scanning direction. Symbol "REFBD*" designates the target BD signal, which is generated by the counter 31 of the scanner motor control circuit 29. Symbol "BD*" designates the actual BD signal, which is generated by the beam detection signal (BD signal) generating circuit 200 as a synchronizing signal for the start of the print in the main scanning direction. Symbol "LAG*"n designates a LAG signal, which represents the phase lag of the actual BD signal (BD*) from the target BD signal (REFBD*), and is output from the phase comparison circuit 34 of the scanner motor control circuit 29.

Symbol "LEAD*" designates a LEAD signal, which represents the phase lead of the actual BD signal (BD*) from the target BD signal (REFBD*), and is output from the phase comparison circuit 34 of the scanner motor control circuit 29. It should be noted that the LAG signal (LAG*) goes "low" only when the phase of the actual BD signal (BD*) lags behind that of the target BD signal (REFBD*), and the LEAD signal (LEAD*) goes "low" only when the phase of the actual BD signal (BD*) leads that of the target BD signal (REFBD*). Symbol "CPUMP" designates a synthesized signal of the LAG signal (LAG*) and the LEAD signal (LEAD*) output from the phase comparison circuit 34 of the scanner motor control circuit 29, which is generated by the charge pump circuit 35 of the scanner motor control circuit 29. Symbol "Is" designates a current which is actually output to the scanner motor main body 8-2.

With reference to FIG. 7, a description will now be given of the PLL control operation by the scanner motor control/driving circuit (frequency divider 41 through resistor 48) inside the scanner motor 8 shown in FIG. 6.

First, in FIG. 7, before the top signal generating section 22 generates the top signal (TOP*), the rotational speed of the scanner motor 8 is controlled by the speed discriminator control and the PLL control such that the phase of the target BD signal (REFBD*) and that of the actual BD signal (BD*) coincide with each other.

Then, when the top signal (TOP*) is generated, the counter 31 of the scanner motor control circuit 29 that is generating the target BD signal (REFBD*) is immediately cleared at the falling edge of the top signal (TOP*), whereupon the counter 31 restarts the count operation, so that the target BD signal (REFBD*) is newly generated. Since the speed of the scanner motor 8 cannot be changed rapidly, the actual BD signal (BD*) continues to be output with the same period. The phase comparison circuit 34 of the scanner motor control circuit 29 outputs the LAG signal (LAG*) at "low" level only when the phase of the actual BD signal (BD*) lags behind the phase of the target BD signal (REFBD*), and outputs the LEAD signal (LEAD*) at "low" level only when the phase of the actual BD signal (BD*) leads the phase of the target BD signal (REFBD*).

Namely, the phase comparison circuit 34 of the scanner motor control circuit 29 outputs the LAG signal (LAG*) at "low" while the LEAD signal (LEAD*) remains "high" when the phase of the actual BD signal (BD*) lags behind the phase the target BD signal (REFBD*), and outputs the LEAD signal (LEAD*)at "low" while the LAG signal (LAG*) remains "high" when the phase of the actual BD signal (BD*) leads the phase of the target BD signal (REFBD*).

The charge pump circuit 35 of the scanner motor control circuit 29 synthesizes the LAG signal (LAG*) indicating the phase lag and the LEAD signal (LEAD*) indicating the phase lead into the CPUMP signal. The charge pump circuit 35 of the scanner motor control circuit 29 is configured such that a positive ("+") voltage for accelerating the scanner motor 8 is generated if the phase lags, and output a negative ("−") voltage for decelerating the scanner motor 8 is generated if the phase leads.

When this control signal is input as a signal relating to the PLL control to the scanner motor control/driving circuit of the scanner motor 8 in FIG. 6, the scanner motor 8 is controlled to have its speed slightly increased so that the phase lag gradually decreases, and the scanner motor 8 is controlled continuously so as to be maintained at the equilibrium. Specifically, the actual BD signal (BD*) comes in phase with the target BD signal (REFBD*), with the speed difference being zero, and the phase difference cancels or eliminates the speed deviation in the speed discriminator 42 of the scanner motor 8, whereby the equilibrium is maintained.

If printing is started at a time when the actual BD signal (BD*) comes in phase with the target BD signal (REFBD*), the printing positions (printing start positions in the sub scanning direction) for the respective colors can be accurately aligned with each other. Further, even during the printing operation the scanner motor control circuit 29 operates to keep the actual BD signal (BD*) in phase with the target BD signal (REFBD*), so that the scanner motor 8 can be controlled such that the actual BD signal (BD*) and the target BD signal (REFBD*) are synchronized until the end of the printing operation.

In this way, even in the image forming apparatus 100 where the one-turn time period of the intermediate transfer belt 4 is not set to an integer multiple of the BD period, it is possible to bring the main scanning synchronizing signal and the sub scanning synchronizing signal (top signal) into phase with each other.

A detailed description will now be given of operations and effects specific to the image forming apparatus 100 according to the present embodiment constructed as described above.

Figure 8:
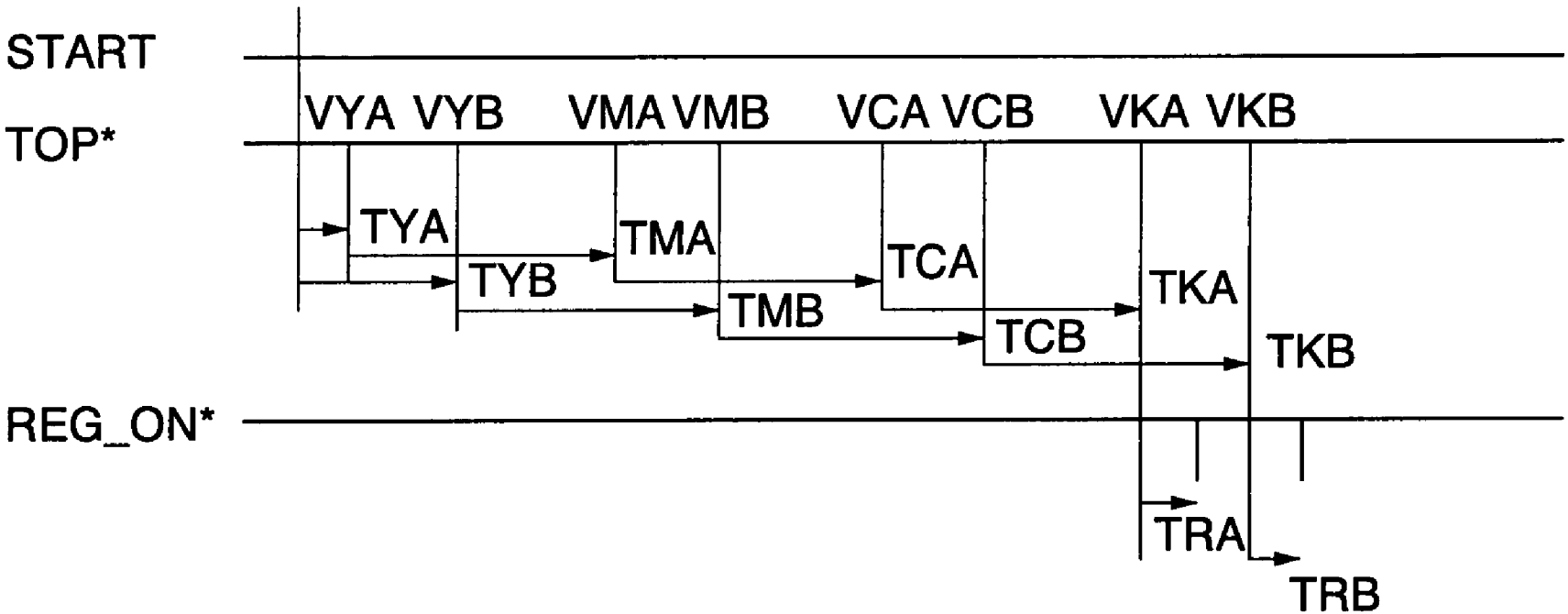
FIG. 8 is a sequence diagram showing generation of a TOP signal (TOP*) in a color print by the image forming apparatus 100 in FIG. 1.

FIG. 8 is a sequence diagram showing generation of the TOP signal (TOP*) in a color print by the image forming apparatus 100 in FIG. 1. The intermediate transfer belt 4 used in the present embodiment allows two-sheet attachment of recording sheets in A4 size, for example, on the one-turn circumferential length (i.e. allows forming images corresponding to two recording sheets on the intermediate transfer belt 4 at the same time), and FIG. 8 shows a sequence of color image formation for the two-sheet attachment for small-sized recording sheets such as A4. It should be noted that counters for the respective colors such as a yellow face-A (YA) counter and a yellow face-B (YB) counter, described later, are provided inside the top signal generating section 22.

In FIG. 8, first, the electrical START signal is generated according to the program as a trigger to cause the yellow face-A (YA) counter and the yellow face-B (YB) counter to start counting at the same time. Here, the face A (the face of a recording sheet at an odd number-th position in a sequence of the recording sheets) corresponds to the first half of the one turn of the intermediate transfer belt 4, and the face B the (face of a recording sheet at an even number-th position) corresponds to the latter half of the same. As shown in FIG. 8, a VYA* signal and a VYB* signal as TOP signals (TOP*) corresponding respectively to the face A and the face B of yellow (Y) are generated when respective predetermined count time periods (TYA and TYB) elapse. These signals are received as the write timing of the laser 6 by the scanner unit 1, thereby causing the emission of laser light from the laser 6. In this way, latent images of the data of yellow (Y) are formed on the photosensitive drum 3.

Then, a VMA* signal and a VMB* signal as top signals (TOP*) corresponding respectively to the face A and the face B of magenta (M), are generated when start timing of respective predetermined count time periods (TMA and TMB) approximately corresponding to the one-turn time period of the intermediate transfer belt is reached after the generation of the VYA* and VYB* signals of yellow (Y) as triggers. These signals are received as the write timing of the laser 6 in the scanner unit 1, thereby causing emission of laser light from the laser 6. In this way, latent images of the data of magenta (M) are formed on the photosensitive drum 3.

Then, similar control is also carried out for cyan (C) and black (Bk), so that latent images according to the data of cyan (C) and black (Bk) are formed on the photosensitive drum 3. After the developers of the four colors are thus overlapped on the intermediate transfer belt 4, respective registration-on signals (RA and RB) are sequentially generated based on registration-on counters which started respective counting operations with reference to the respective VKA* and VKB* signals as the top signals (TOP*) of black (Bk), to thereby cause recording sheets 17 to be fed from the sheet feed cassette 18 or the manual feed cassette 19 and then bring them into contact with the secondary transfer roller 11, so that the developers of the four colors on the intermediate transfer belt 4 are secondarily transferred onto the recording sheets 17.

Figure 9:
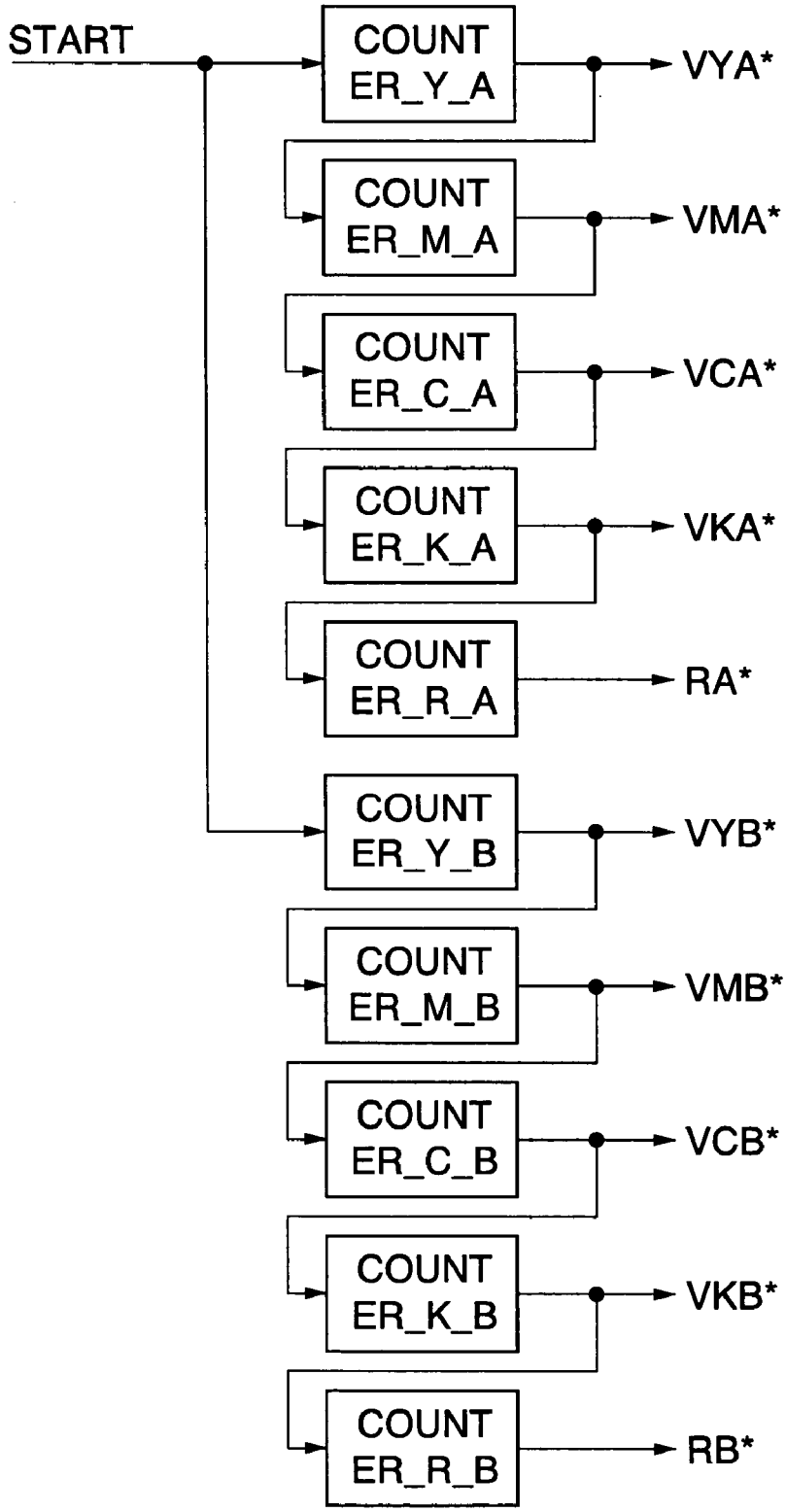
FIG. 9 is a diagram showing the circuit configuration of video data request signal generation counters corresponding to the respective colors (yellow, magenta, cyan, and black) of the image forming apparatus 100 in FIG. 1.

FIG. 9 is a diagram showing the circuit configuration of video data request signal generation counters corresponding to the respective colors (yellow, magenta, cyan, and black) of the image forming apparatus 100 according to the first embodiment. In FIG. 9, the sequence of the first embodiment is enabled by a cascade construction where the START signal described above is input to the face-A and face-B counters of the first color, yellow (Y), and the top signals generated by the counters of previous colors trigger counters of the respective following colors.

Figure 10:
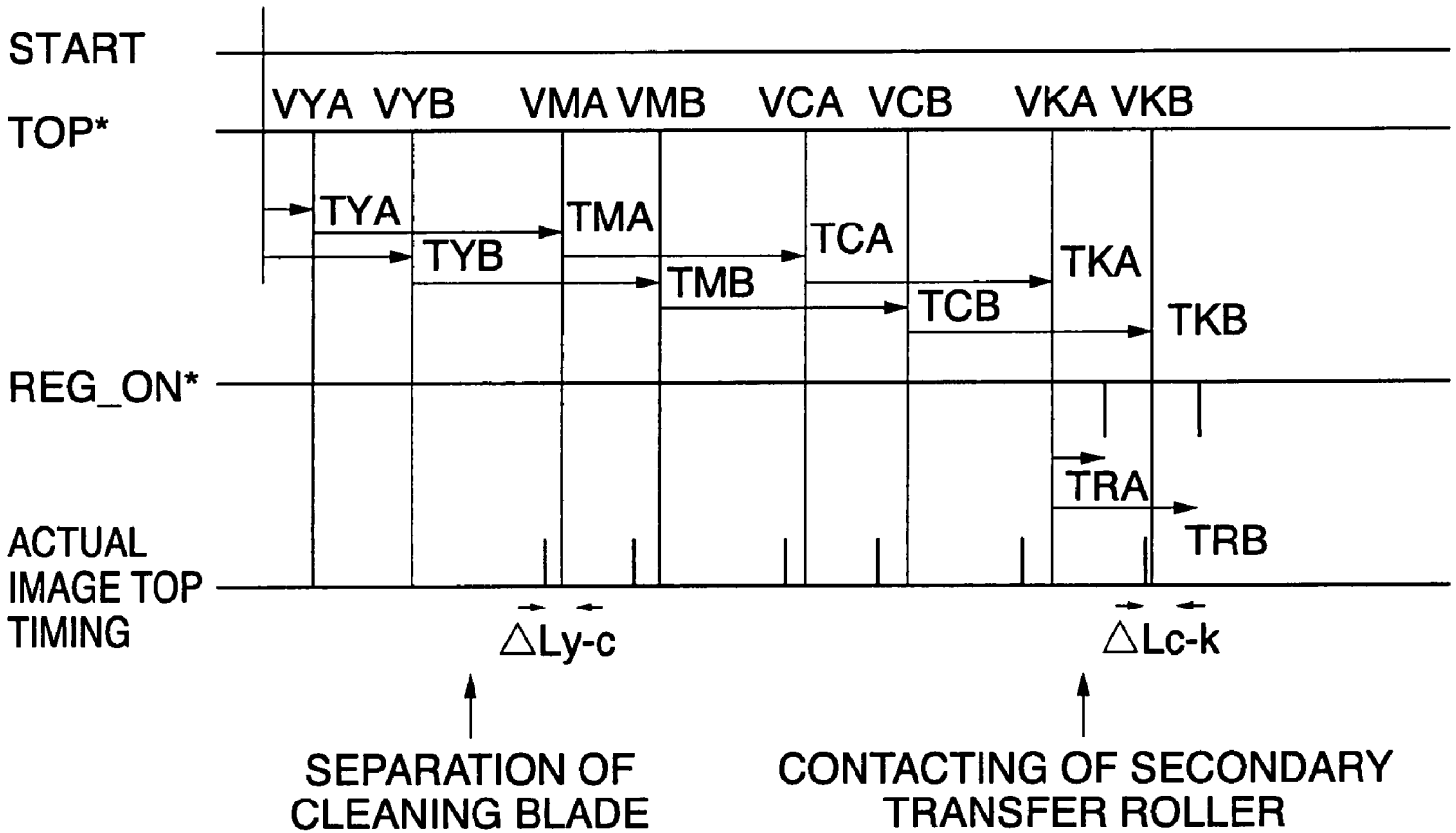
FIG. 10 is a sequence diagram showing image top timing in an actual color print by the image forming apparatus 100 in FIG. 1.

FIG. 10 shows a sequence of image top timing in an actual color print by the image forming apparatus, in which mechanical shocks generated during actual image formation (such as a mechanical shock caused by the separation of the cleaning blade 15 during the formation of toner images on the intermediate transfer belt 4) based on the construction of the image forming apparatus 100 shown in FIGS. 1, 2, 4, 5, and 6, and the top signal generation sequence in a color print shown in FIG. 8.

The sequence diagram of FIG. 10 shows the sequence of FIG. 8 and further shows timing of mechanical shocks applied to the intermediate transfer belt 4 and corresponding actual image top timing. As shown in FIG. 10, in an actual image formation by the image forming apparatus 100, the cleaning blade 15 which has been in contact with the intermediate transfer belt 4 for cleaning the intermediate transfer belt 4 as the preprocessing of the image formation for the four colors, is separated from the intermediate transfer belt 4 at a point in the latter half of the yellow (Y) face-B image formation, and is brought into contact with the intermediate transfer belt 4 at a point in the latter half of the black (Bk) face-B image formation as the post processing for cleaning. Also, the second transfer roller 11 comes into contact with the intermediate transfer belt 4 in timing in which the developers of the four colors overlapped on the intermediate transfer belt 4 are transferred onto the recording sheet (at a point in the latter half of the Black (Bk) face-A image formation in FIG. 10), as described earlier.

In actuality, the separation of the cleaning blade 15 from the intermediate transfer belt 4 from the contact state acts to reduce the load toque applied to the intermediate transfer belt 4, and consequently the intermediate transfer belt 4 rotates (moves in the circumferential direction thereof) faster momentarily. Conversely, the contacting of the cleaning blade 15 with the intermediate transfer belt 4 from the separate state acts to increase the load torque applied to the intermediate transfer belt 4, and consequently the intermediate transfer belt 4 rotates slower momentarily. Also when the secondary transfer roller 11 comes into contact with the intermediate transfer belt 4, this contacting motion acts to increase the load torque applied to the intermediate transfer belt 4, and consequently the intermediate transfer belt 4 rotates slower momentarily.

In this way, the rotation or circumferential motion of the intermediate transfer belt 4 varies due to the above-mentioned mechanical loads (the cleaning blade 15 and the secondary transfer roller 11) being applied to the intermediate transfer belt 4, and consequently the actual image top timing changes i.e. advances or retards as shown in FIG. 10. In the present sequence, the actual image top timing of the respective colors depends upon the top signals (TOP* in the present embodiment) of the respective colors generated by the top signal (TOP*) generation counters of the respective colors, irrespective of the above described load variations. Therefore, a displacement of ΔL occurs in the actual image top timing as shown in FIG. 10, and an accumulation of such displacements for the respective colors in the image formation of the four colors results in color misalignment in the full-color image formation by the image forming apparatus 100. Specifically, as shown in FIG. 10, the one-turn time period for both the face A and face B in the area from yellow (Y) to magenta (M) on the intermediate transfer belt 4 decreases by ΔLy-c due to the separation of the cleaning blade 15 from the intermediate transfer belt 4. Also, the one-turn time period in the area from cyan (C) to black (Bk) on the intermediate transfer belt 4 increases by ΔLc-k due to the contacting of the secondary transfer roller 11 with the intermediate transfer belt 4. The actual color misalignment due to these variations of the one-turn time period is approximately 50 μm to 100 μm (description and illustration of the contacting of the cleaning blade 15 and the separation of the secondary transfer roller 11 are omitted since these actions have negligibly small influences in the present embodiment).

However, the generation timing of the above described shocks due to the separation of the cleaning blade 15 from the intermediate transfer belt 4 and due to the contacting of the secondary transfer roller 11 with the intermediate transfer belt 4 is fixed in the image forming sequence, and hence the actual variations of the rotation of the intermediate transfer belt 4 due to these shocks have a certain periodicity.

Figure 11A:
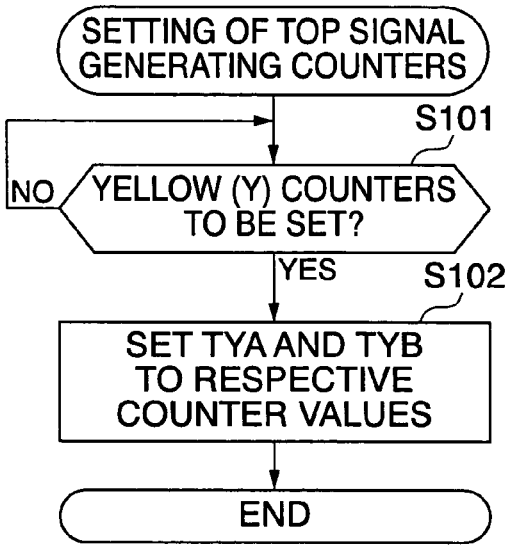
Figure 11B:
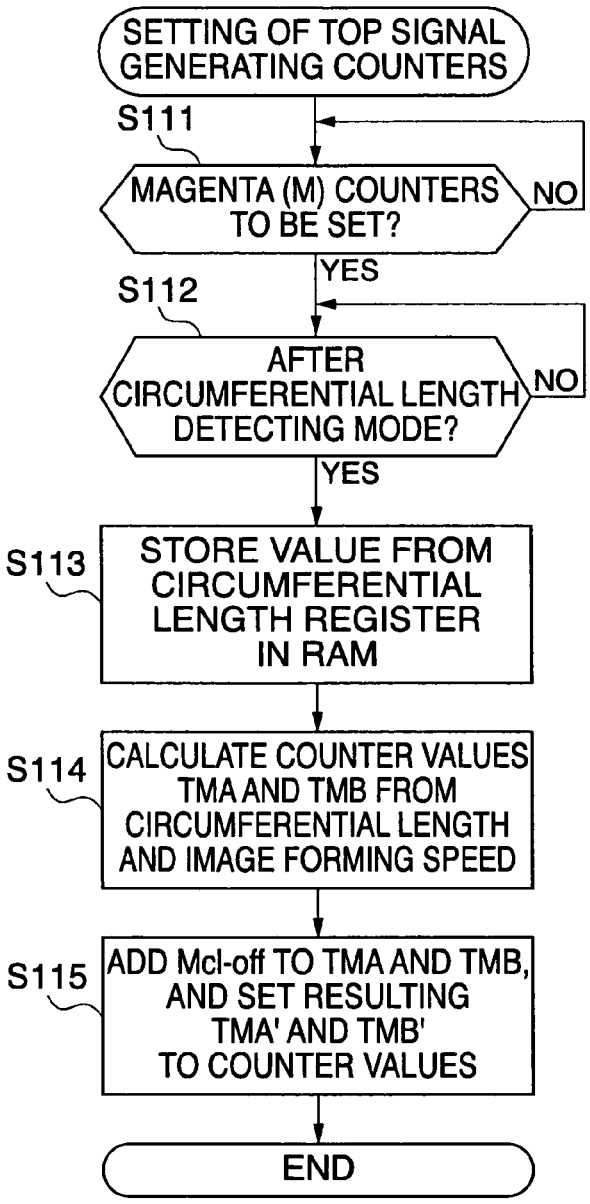
Figure 12A:
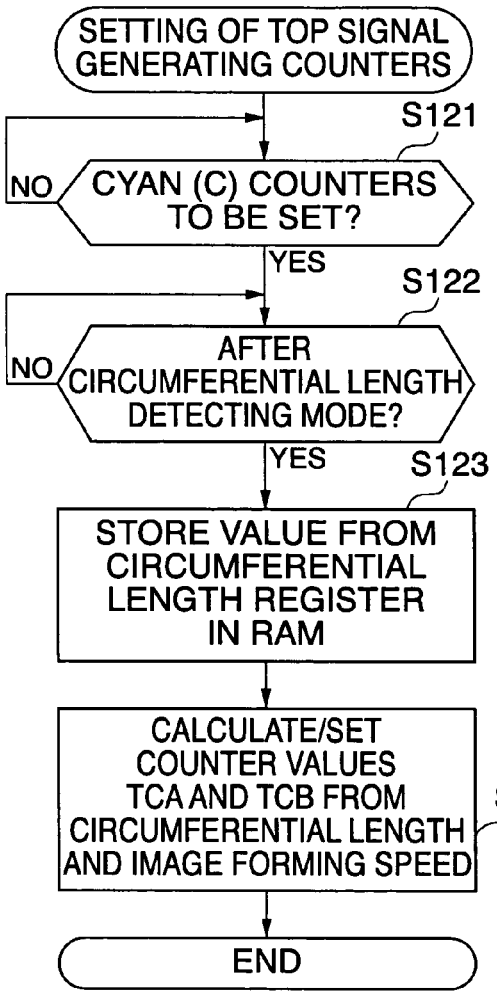

FIGS. 11A, 11B, 12A, and 12B are flowcharts the procedure of setting the top signal generating counters. FIG. 11A shows the setting of the top signal generating counters for yellow; FIG. 11B, magenta; FIG. 12A, cyan; and FIG. 12B, black.

First, as shown in FIG. 11A, if the setting of the yellow (Y) counters is to be carried out ("YES" to a step S100), since the time period from the generation of the START signal to that of the image top signal for yellow (Y) is constant irrespective of the circumferential length of the intermediate transfer belt 4, the counter values TYA for the face A and TYB for the face B are respectively set to predetermined values (step S101).

Then, as shown in FIG. 11B, if the setting of the magenta (M) counters is to be carried out ("YES" to a step S111), and if the present time is after a circumferential length detecting mode where the circumferential length of the intermediate transfer belt 4 is detected (namely, the circumferential length of the intermediate transfer belt 4 has been measured, and the actual circumferential length value has been stored in the circumferential length register section 304 in the circumferential length detecting counter 307) ("YES" to a step S112), the circumferential length of the intermediate transfer belt 4, which has been measured by the circumferential length detecting sensor 5 and stored in the circumferential length register section 304 in the circumferential length detecting counter 307, is stored in a RAM, not shown, in the CPU 306 (step S113). Then, the counter values TMA and TMB corresponding to the one-turn time period of the intermediate transfer belt 4 are calculated based on the circumferential length of the intermediate transfer belt 4 stored in the RAM of the CPU 306, and a predetermined image forming speed (step S114). Then, an offset value Mc1-off of the time period corresponding to the rotation variation of the intermediate transfer belt 4 due to the mechanical shock generated by the separation of the cleaning blade 15 from the intermediate transfer belt 4 is added to the calculated counter values TMA and TMB, to thereby set target values for the magenta (M) counters, TMA' and TMB', respectively for the surface A and the surface B (step S115).

Then, as shown in FIG. 12A, if the setting of the cyan (C) counters is to be carried out ("YES" to a step S121), and if the present time is after the circumferential length detecting mode where the circumferential length of the intermediate transfer belt 4 is detected ("YES" to a step S122), the circumferential length of the intermediate transfer belt 4, which has been measured by the circumferential length detecting sensor 5 and stored in the circumferential length register section 304 in the circumferential length detecting counter 307, is stored in the RAM, not shown, in the CPU 306 (step S123). Then, the counter values TCA and TCB corresponding to the one-turn time period of the intermediate transfer belt 4 are calculated based on the circumferential length of the intermediate transfer belt 4 stored in the RAM of the CPU 306, and the predetermined image forming speed (step S124). Since there is no expected mechanical shock in the image forming process corresponding to the time period from magenta (M) to cyan (C), target values TCA and TCB of the cyan (C) counters are respectively set for the face A and the face B.

Figure 12B:
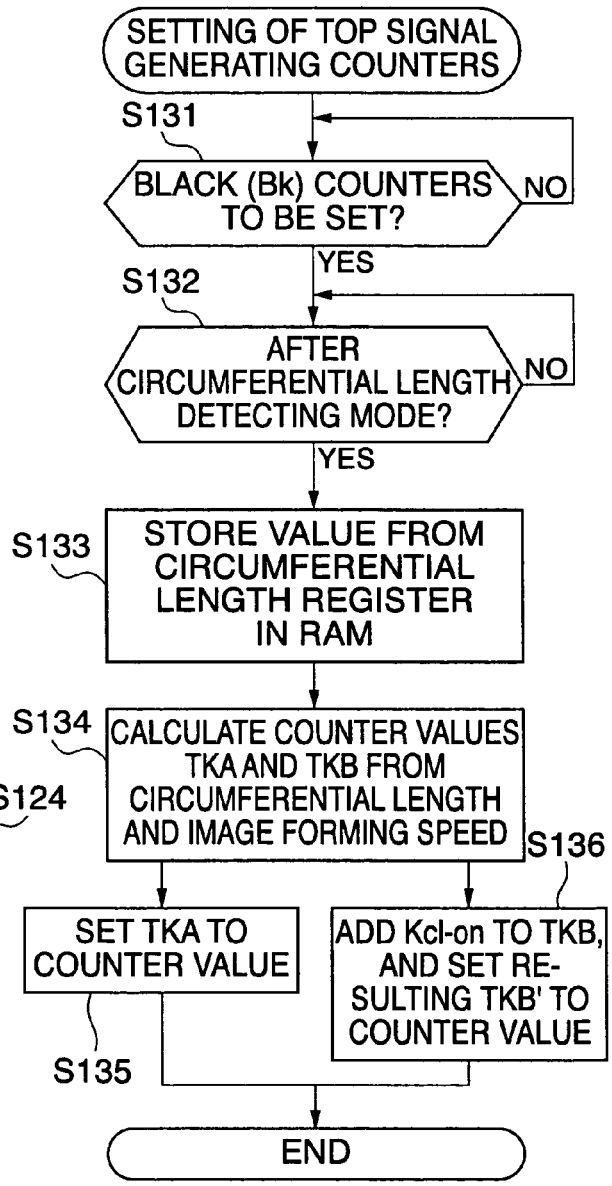

Finally, as shown in FIG. 12B, if the setting of the black (Bk) counters is to be carried out ("YES" to a step S131), if the present time is after the circumferential length detecting mode where the circumferential length of the intermediate transfer belt 4 is detected ("YES" to a step S132), the circumferential length of the intermediate transfer belt 4, which has been measured by the circumferential length detecting sensor 5 and stored in the circumferential length register section 304 in the circumferential length detecting counter 307, is stored in the RAM, not shown, in the CPU 306 (step S133). Then, the counter values TKA and TKB corresponding to the one-turn time period of the intermediate transfer belt 4 are calculated based on the circumferential length of the intermediate transfer belt 4 stored in the RAM of the CPU 306, and the predetermined image forming speed (step S134). Since there is no mechanical shock on the intermediate transfer belt 4 during the time period corresponding to the face A, the target value TKA of the black face A (BA) counter is set for the face A (step S135). On the other hand, as for the face B, added to the target value TKB is an offset value Kc1-on of the time period corresponding to the circulation variation of the intermediate transfer belt 4 due to the mechanical shock generated by the contacting of the secondary transfer roller 11 to the intermediate transfer belt 4, thereby setting the target value for the black (Bk) counter, TKB', for the surface B (step S136).

By setting the target values as described above with reference to FIGS. 11A, 11B, 12A, and 12B, it is possible to generate the top signals (TOP*) for the respective colors approximately in synchronism with the actual image top timing even when the separation of the cleaning blade 15 from the intermediate transfer belt 4, and the contacting of the secondary transfer roller 11 with the intermediate transfer belt 4 occur in the image forming sequence as shown in FIG. 10. As a result, a proper image can be output without a large color misalignment by the image forming apparatus 100.

As described above, according to the first embodiment, it is possible to prevent color misalignment which occurs between first and subsequent colors during the color overlapping process due to variations of the one-turn time period of the intermediate transfer belt 4 between the respective colors caused by mechanical load variations causing differences in the rotational speed of the intermediate transfer belt 4, which are generated by the contacting of the respective loads (such as the cleaning blade 15 and the secondary transfer roller 11) with the intermediate transfer belt 4, and the separation of them from the intermediate transfer belt 4 for the primary transfer in the image forming process.

A description will now be given of a second embodiment of the present invention. An image forming apparatus, a circumferential length detecting counter, a scanner motor control system, a scanner motor control circuit and a scanner motor control/driving circuit according to the present embodiment are identical with those of the above described first embodiment (FIGS. 1 and 2, and FIGS. 4 to 6), and hence detailed description thereof is omitted.

The present embodiment is characterized in that the environment sensor 13 is provided in the periphery of the intermediate transfer belt 4 (on the outer peripheral side thereof, for example) as shown in FIG. 1, to monitor the humidity and temperature and calculate the amount of moisture in the periphery of the intermediate transfer belt 4. Specifically, the environment sensor 13 detects the temperature and humidity, and based on the detection result of the environment sensor 13, the amount of moisture around the intermediate transfer belt 4 is calculated by the CPU 301 (FIG. 2).

Figure 13:
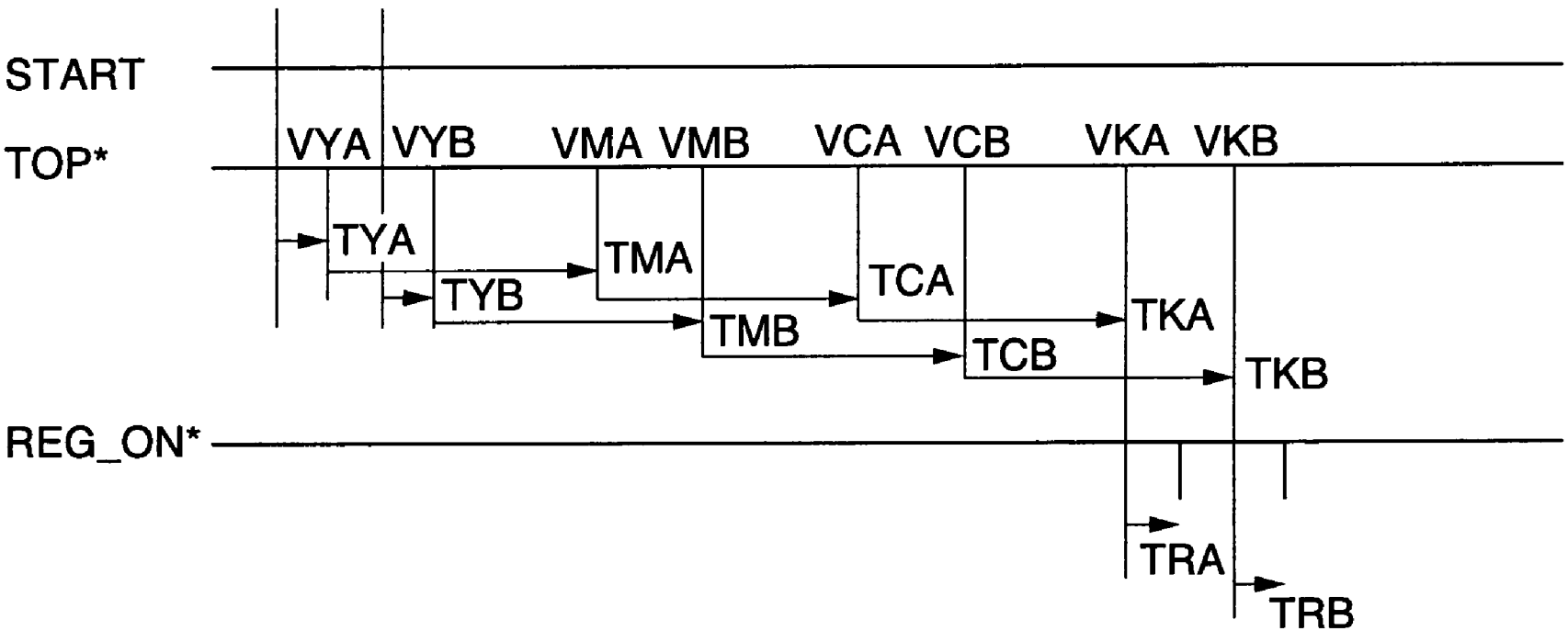
FIG. 13 is a sequence diagram showing generation of TOP signals (TOP*) for the color print by an image forming apparatus 100 according to a second embodiment of the present invention.

FIG. 13 is a sequence diagram showing the generation of TOP signals (TOP*) generation for the color print by the image forming apparatus 100 according to the second embodiment. In the present embodiment, the intermediate transfer belt 4 allows the two-sheet attachment of recording sheets in A4 size, for example, on the one-turn circumferential length as is the same with the first embodiment, and FIG. 13 shows the sequence of color image formation for the two-sheet attachment for small size recording sheets such as A4.

In FIG. 13, electrical START signals generated respectively for the face A and face B as triggers according to a program cause the yellow face-A (YA) counter and the yellow face-B (YB) counter to start counting. As shown in FIG. 13, the VYA* signal and the VYB* signal corresponding respectively to the face A and the face B of yellow (Y) are generated when the respective predetermined count time periods (TYA and TYB) elapse. These signals are received as the write timing of the laser 6 in the scanner unit 1, thereby causing the emission of laser light from the laser 6. In this way, latent images of the data yellow (Y) are formed on the photosensitive drum 3.

Then, the VMA* signal and the VMB* signal as top signals (TOP*) corresponding respectively to the face A and the face B of magenta (M) are generated when the respective predetermined count time periods (TMA and TMB) approximately corresponding to the one-turn time period of the intermediate transfer belt 4 elapse from the VYA* and VYB* signals of yellow (Y) as triggers. These signals are received as the write timing of the laser 6 in the scanner unit 1, thereby causing the emission of laser light from the laser 6. In this way, latent images of the data of magenta (M) are formed on the photosensitive drum 3.

Then, similar control is also carried out for cyan (C) and black (Bk), so that latent images according to the data of cyan (C) and black (Bk) are formed on the photosensitive drum 3. After the developers of the four colors are overlapped on the intermediate transfer belt 4, the respective registration-on signals (RA and RB) are sequentially generated based on the registration-on counters which started respective counting operations with reference to the respective VKA* and VKB* signals as the top signals (TOP*) for black (Bk), to thereby cause recording sheets 17 to be fed from the sheet feed cassette 18 or the manual feed cassette 19 and then bring them into contact with the secondary transfer roller 11, so that the developers of the four colors on the intermediate transfer belt 4 are secondarily transferred onto the recording sheets 17.

Figure 14:
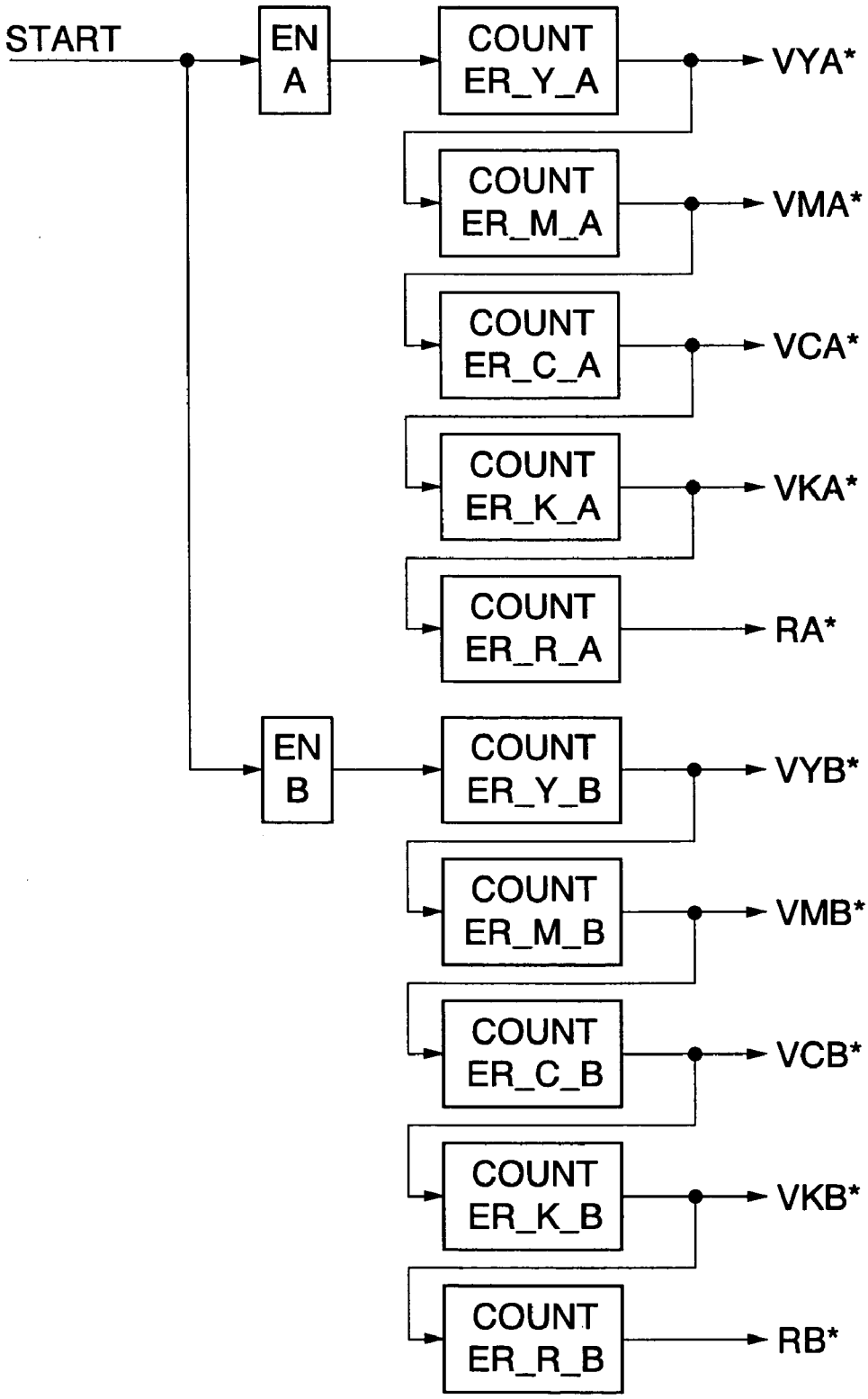
FIG. 14 is a diagram showing the circuit configuration of video data request signal generation counters corresponding to the respective colors (yellow, magenta, cyan, and black) of the image forming apparatus 100 in FIG. 13.

FIG. 14 is a diagram showing the circuit configuration of the video data request signal generation counters corresponding to the respective colors (yellow, magenta, cyan, and black) of the image forming apparatus 100 according to the second embodiment. The sequence of the second embodiment is enabled by a cascade construction where gates, ENABLE_A and ENABLE_B, are provided respectively on prior stages of the face-A and face-B counters of the first color of yellow (Y) as compared with the circuit configuration (FIG. 9) of the first embodiment, and the START signal is input for the face A and the face B by toggling the ON/OFF of the respective gates, and video data request signals generated by the counters of previous colors trigger the counters of the respective following colors.

In the present embodiment, in addition to the correction of the circumferential length variation caused by mechanical shocks, the circumferential length value of the intermediate transfer belt 4 measured in the circumferential length detecting mode where the circumferential length of the intermediate transfer belt 4 is detected can be changed when the level of the moisture quantity calculated using the environment sensor 13 exceeds a predetermined level, to thereby correct a circumferential length variation of the intermediate transfer belt 4 generated by an environment change which occurs when image formation on a large number of recording sheets and output thereof are carried out. By reflecting the changed circumferential length value upon the target values of the top signal (TOP*) generation counters for the respective colors, it is possible to cope with an aging change in the circumferential length of the intermediate transfer belt 4 due to an environmental change, namely a change in the moisture quantity around the intermediate transfer belt 4 during execution of an image formation job of forming images on recording sheets.

In actuality, the temperature inside the image forming apparatus 100 increases by 30° C. or so over long-term execution of an image formation job which is started at a room temperature, and the humidity changes accordingly. The circumferential length of the intermediate transfer belt 4 (made of a polyimide material in the present embodiment) actually changes by a few micrometers.

Figure 15A:
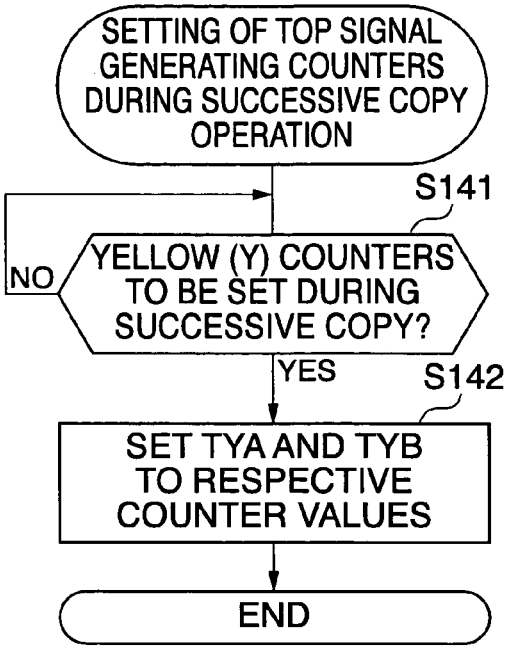
Figure 15B:
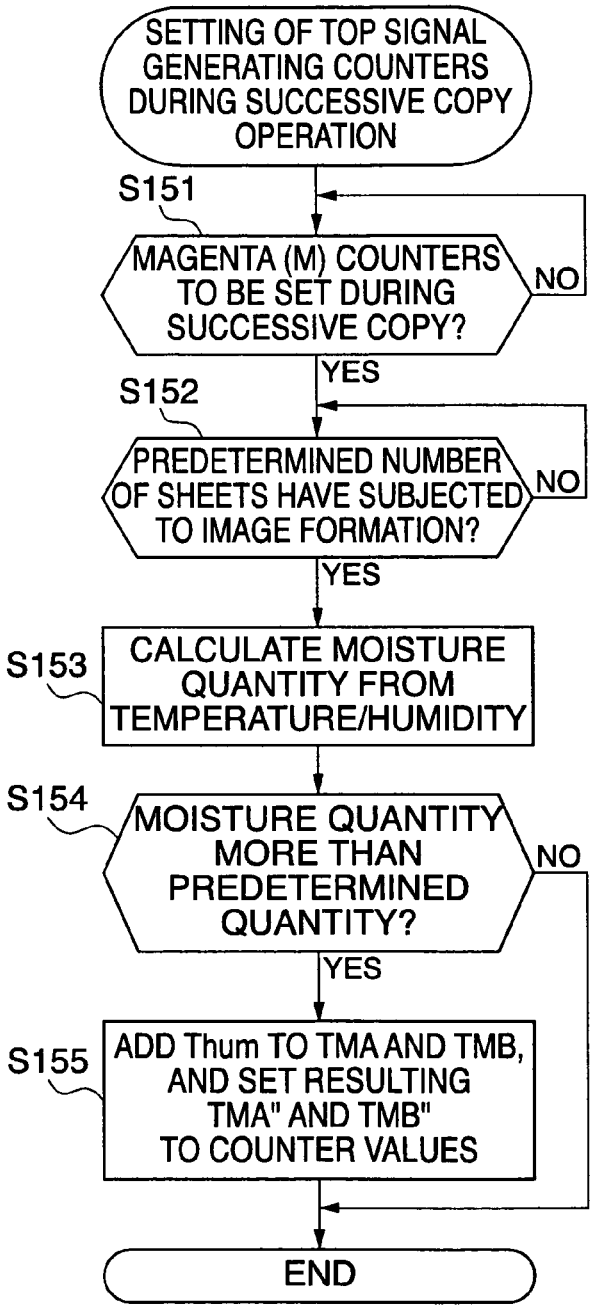
Figure 16A:
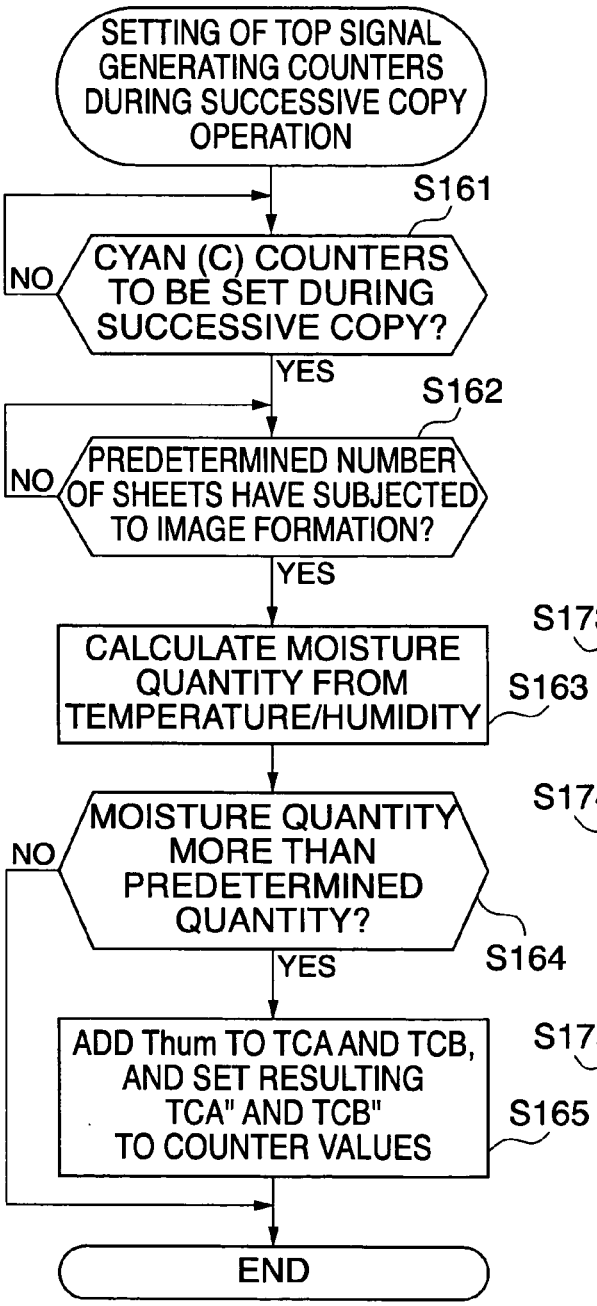

FIGS. 15A, 15B, 16A, and 16B are flowcharts the procedure of setting the top signal generating counters during a successive copy operation. FIG. 15A shows the setting of the top signal generating counter for yellow; FIG. 15B, magenta; FIG. 16A, cyan; and FIG. 16B, black during the successive copy operation.

First, as shown in FIG. 15A, if the setting of the yellow (Y) counters is to be carried out ("YES" to a step S141), since the time period from the generation of the START signal to that of the top signal for yellow (Y) is constant irrespective of the circumferential length of the intermediate transfer belt 4, the counter values TYA for the face A and TYB for the face B are respectively set to predetermined values (step S141).

Then, as shown in FIG. 15B, if the setting of the magenta (M) counters is to be carried out ("YES" to a step S151), whenever a predetermined number of sheets have been subjected to image formation after the start of the successive copy operation ("YES" to a step S152), the moisture quantity around the intermediate transfer belt 4 is calculated based on the temperature and humidity detected by the environment sensor 13 (step S153). Further, the calculated moisture quantity around the intermediate transfer belt 4 and the moisture quantity acquired at the time of the detection of the circumferential length of the intermediate transfer belt 4 are compared ("YES" in step S154). If the difference between the moisture quantities is more than a predetermined quantity, a counter offset value Thum according to the environmental change calculated based on an offset value Lhum of the intermediate transfer belt 4 according the moisture difference is added to the magenta counter values TMA and TMB which have already been set, to thereby newly set environmentally-corrected target values TMA' and TMB' for the face A and face B (step S155).

Figure 16B:
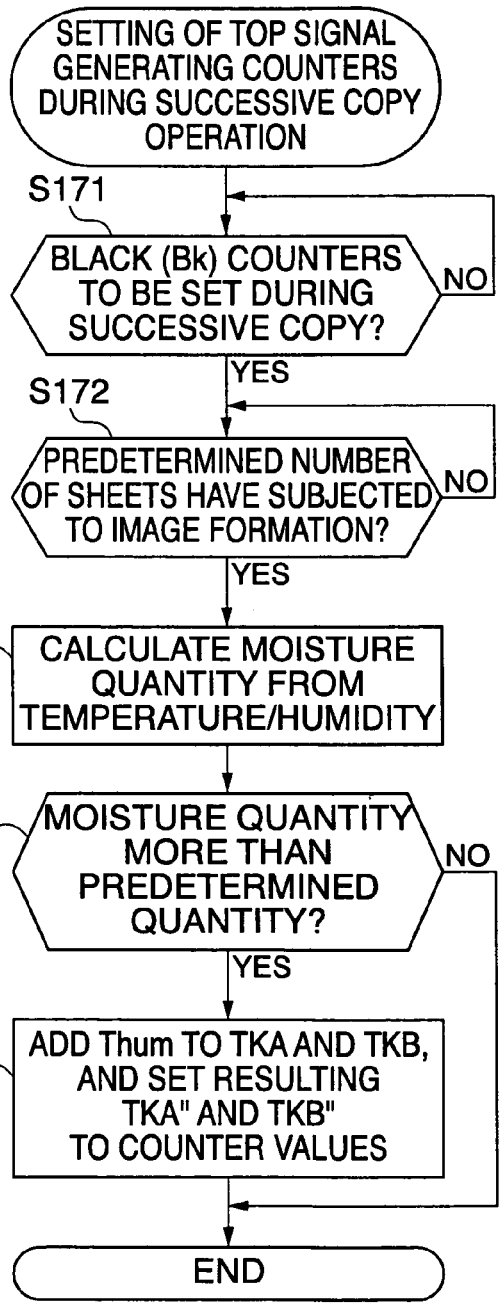

Thereafter, the counter offset value Thum is added respectively to the counter values of cyan (C) and black (Bk) for the face A and the face B in a similar manner as the counter target values of magenta (M), as shown in FIGS. 16A and 16B, (steps S161 through S165 in FIG. 16A and S171 through S175 in FIG. 16B).

In this way, according to the present embodiment, deviation of the image top timing due to a circumferential length change of the intermediate transfer belt 4 caused by-an environmental change over time during a successive copy operation can be corrected in addition to the correction for mechanical shocks applied to the intermediate transfer belt 4 described with reference to the first embodiment. As a result, the top signals (TOP*) of the respective colors in more accurate timing according to the actual image top timing than in the first embodiment, to thereby enable the image forming apparatus 100 to output a proper image without a large color misalignment.

As described above, according to the second embodiment, it is possible to prevent color misalignment which occurs between first and subsequent colors during the color overlapping process due to variations of the one-turn time period of the intermediate transfer belt 4 between the respective colors caused by mechanical load variations causing differences in the rotational speed of the intermediate transfer belt 4, which are generated by the contacting of the respective loads (such as the cleaning blade 15 and the secondary transfer roller 11) with the intermediate transfer belt 4, and the separation of them from the intermediate transfer belt 4 for the primary transfer in the image forming process. In addition, according to the second embodiment, it is possible to reduce a color misalignment due to a change circumferential length of the intermediate transfer belt 4 caused by an environmental change over time during a successive copy operation.

It should be understood that the present invention is not limited to the first and second embodiments described above, but various variations of the above described embodiments may be possible without departing from the spirit of the present invention.

Although in the first and second embodiments, the intermediate transfer belt 4 is used as the intermediate transfer member provided in the image forming apparatus 100, the present invention is not limited to this, and may be applied to a case where an intermediate transfer drum is used as the intermediate transfer member.

Although in the first and second embodiments, the two-sheet attachment of recording sheets in A4 size along the one-turn circumferential length of the intermediate transfer belt 4 of the image forming apparatus 100 is employed, the present invention is not limited to this, and it is possible to arbitrarily set the size of recording sheets and the number of images corresponding to the recording sheets, attached or formed on the intermediate transfer belt 4 within the spirit of the present invention.

Although in the above described embodiments, a copying machine is employed as the image forming apparatus 100, the present invention is not limited to this, and may be also applied to a printer and a multifunction apparatus.

It goes without saying that the object of the present invention may also be accomplished by supplying a system or an apparatus with a storage medium (or a recording medium) in which a program code of software, which realizes the functions of either of the above described embodiments is stored, and causing a computer (or CPU or MPU) of the system or apparatus to read out and execute the program code stored in the storage medium.

In this case, the program code itself read from the storage medium realizes the novel functions of either of the above described embodiments, and hence the program code and a storage medium on which the program code is stored constitute the present invention.

Examples of the storage medium for supplying the program code include a floppy (registered trademark) disk, a hard disk, an optical disk, a magnetic-optical disk, a CD-ROM, a CD-R, a CD-RW, a DVD-ROM, a DVD-RAM, a DVD-RW, DVD+RW, a magnetic tape, a nonvolatile memory card, a ROM, and an EEPROM. Alternatively, the program is supplied by downloading via a network or the like.

Moreover, it is to be understood that the functions of either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of either of the embodiments described above may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. An image forming apparatus that carries out image formation by primarily transferring an image electrophotographically formed on an image carrier onto a rotatably driven intermediate transfer member, and then secondarily transferring the images on said intermediate transfer member onto a recording medium, comprising:

a controller that controls an image forming operation of primarily transferring the image onto said intermediate transfer member, according to a length of said intermediate transfer member in a circumferentially moving direction thereof and a variation of a predetermined parameter relating to said intermediate transfer member;

a circumferential length detecting device that detects a circumferential length as the length of said intermediate transfer member in the circumferentially moving direction thereof;

a signal generating device that generates an image formation start signal for a plurality of respective colors;

a target value setting device that sets a target value of image formation timing to be input to said signal generating device based on the circumferential length detected by said circumferential length detecting device; and an offset value adding device that adds an offset value determined according to an expected load variation to the target value set by said target value setting device, wherein said circumferential length detecting device comprises a reference member detecting device that detects a reference member attached to said intermediate transfer member, and a measuring device that measures a time period elapsed from generation of a first detection signal acquired from said reference member detecting device to generation of a second detection signal acquired from said reference member detecting device as a result of circumferential movement of said intermediate transfer member.

2. An image forming apparatus that carries out image formation by primarily transferring an image electrophotographically formed on an image carrier onto a rotatably driven intermediate transfer member, and then secondarily transferring the images on said intermediate transfer member onto a recording medium, comprising:

a controller that controls an image forming operation of primarily transferring the image onto said intermediate transfer member, according to a length of said intermediate transfer member in a circumferentially moving direction thereof and a variation of a predetermined parameter relating to said intermediate transfer member;

a circumferential length detecting device that detects a circumferential length as the length of said intermediate transfer member in the circumferentially moving direction thereof;

a signal generating device that generates an image formation start signal for a plurality of respective colors;

a target value setting device that sets a target value of image formation timing to be input to said signal generating device based on the circumferential length detected by said circumferential length detecting device; and an offset value adding device that adds an offset value determined according to an expected load variation to the target value set by said target value setting device, wherein said signal generating device comprises at least two signal generating devices provided respectively for recording mediums at odd and even number-th positions attached to said intermediate transfer member, and said target value setting device sets target values of image formation timing for respective ones of said two signal generating devices.

3. An image forming apparatus that carries out image formation by primarily transferring an image electrophotographically formed on an image carrier onto a rotatably driven intermediate transfer member, and then secondarily transferring the images on said intermediate transfer member onto a recording medium, comprising:

a controller that controls an image forming operation of primarily transferring the image onto said intermediate transfer member, according to a length of said intermediate transfer member in a circumferentially moving direction thereof and a variation of a predetermined parameter relating to said intermediate transfer member;

a circumferential length detecting device that detects a circumferential length as the length of said intermediate transfer member in the circumferentially moving direction thereof;

a signal generating device that generates an image formation start signal for a plurality of respective colors;

a target value setting device that sets a target value of image formation timing to be input to said signal generating device based on the circumferential length detected by said circumferential length detecting device; and an offset value adding device that adds an offset value determined according to an expected load variation to the target value set by said target value setting device, wherein the offset value added by said offset value adding device is for correcting values of mechanical shocks different between respective colors, generated during the image forming operation of primarily transferring the image onto said intermediate transfer member.

4. An image formation control method that carries out image formation by primarily transferring an image electrophotographically formed on an image carrier onto a rotatably driven intermediate transfer member, and then secondarily transferring the images on the intermediate transfer member onto a recording medium, comprising:

a control step of controlling an image forming operation of primarily transferring the image onto the intermediate transfer member, according to a length of the intermediate transfer member in a circumferentially moving direction thereof and a variation of a predetermined parameter relating to the intermediate transfer member;

a circumferential length detecting step of detecting a circumferential length as the length of the intermediate transfer member in the circumferentially moving direction thereof;

a signal generating step of generating an image formation start signal for a plurality of respective colors;

a target value setting step of setting a target value of image formation timing to be input to the signal generating step based on the circumferential length detected in said circumferential lengths detecting step; and an offset value addition step of adding an offset value determined according to an expected load variation to the target value set in said target value setting step, wherein said circumferential length detecting step comprises a reference member detecting step of detecting a reference member attached to the intermediate transfer member, and a measurement step of measuring a time period from generation of a first detection signal acquired in said reference member detecting step to generation of a second detection signal acquired in said reference member detecting step as a result of circumferential movement of the intermediate transfer member.

5. An image formation control method that carries out image formation by primarily transferring an image electrophotographically formed on an image carrier onto a rotatably driven intermediate transfer member, and then secondarily transferring the images on the intermediate transfer member onto a recording medium, comprising:

a control step of controlling an image forming operation of primarily transferring the image onto the intermediate transfer member, according to a length of the intermediate transfer member in a circumferentially moving direction thereof and a variation of a predetermined parameter relating to the intermediate transfer member;

a circumferential length detecting step of detecting a circumferential length as the length of the intermediate transfer member in the circumferentially moving direction thereof;

a signal generating step of generating an image formation start signal for a plurality of respective colors;

a target value setting step of setting a target value of image formation timing to be input to the signal generating step based on the circumferential length detected in said circumferential lengths detecting step; and an offset value addition step of adding an offset value determined according to an expected load variation to the target value set in said target value setting step, wherein said signal generating step comprises at least two signal generating steps provided respectively for recording mediums at odd and even number-th positions attached to the intermediate transfer member, and said target value setting step comprises setting target values of image formation timing for respective ones of said two signal generating steps.

6. An image formation control method that carries out image formation by primarily transferring an image electrophotographically formed on an image carrier onto a rotatably driven intermediate transfer member, and then secondarily transferring the images on the intermediate transfer member onto a recording medium, comprising:

a control step of controlling an image forming operation of primarily transferring the image onto the intermediate transfer member, according to a length of the intermediate transfer member in a circumferentially moving direction thereof and a variation of a predetermined parameter relating to the intermediate transfer member;

a circumferential length detecting step of detecting a circumferential length as the length of the intermediate transfer member in the circumferentially moving direction thereof;

a signal generating step of generating an image formation start signal for a plurality of respective colors;

a target value setting step of setting a target value of image formation timing to be input to the signal generating step based on the circumferential length detected in said circumferential lengths detecting step; and an offset value addition step of adding an offset value determined according to an expected load variation to the target value set in said target value setting step, wherein the offset value added in said offset value addition step is for correcting values of mechanical shocks different between respective colors, generated during the image forming operation of primarily transferring the image onto the intermediate transfer member.

* * * * *